US006536073B2

(12) United States Patent
Uratani et al.

(10) Patent No.: US 6,536,073 B2
(45) Date of Patent: Mar. 25, 2003

(54) ELECTRIC VACUUM CLEANER

(75) Inventors: Hiroyuki Uratani, Shiga (JP); Yoshiaki Ohnishi, Shiga (JP); Toshifumi Miyahara, Shiga (JP); Masaki Shibuya, Shiga (JP); Kazuma Suo, Shiga (JP); Saburo Kajikawa, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/797,058

(22) Filed: Mar. 1, 2001

(65) Prior Publication Data

US 2001/0029641 A1 Oct. 18, 2001

(30) Foreign Application Priority Data

Mar. 1, 2000 (JP) ..... 12-055279
Dec. 5, 2000 (JP) ..... 12-369587
Nov. 24, 2000 (JP) ..... 12-357302

(51) Int. Cl.[7] ..... A47L 9/00

(52) U.S. Cl. ..... 15/327.4; 15/327.2; 15/323; 15/DIG. 1

(58) Field of Search ..... 15/327.4, 327.2, 15/323, DIG. 1

(56) References Cited

U.S. PATENT DOCUMENTS 2,232,548 A * 2/1941 McAnerney ..... 15/327.2
2,543,343 A * 2/1951 Timm ..... 15/323
2,686,330 A * 8/1954 Wales ..... 15/319
2,716,465 A * 8/1955 Meyerhoefer ..... 15/323
2,769,996 A * 11/1956 Shalvoy et al. ..... 15/323
2,814,065 A * 11/1957 Hurd ..... 15/327.2
2,918,693 A * 12/1959 Gasparini ..... 15/323
3,048,961 A * 8/1962 Kemnitz ..... 15/327.2
3,050,921 A * 8/1962 Seyfried ..... 15/327.2
3,217,350 A * 11/1965 Waters et al. ..... 15/323
3,480,987 A * 12/1969 Schaefer ..... 15/323
3,490,089 A * 1/1970 Lagerstrom ..... 15/327.2
3,888,643 A * 6/1975 Yoshikawa et al. ..... 15/323
4,547,927 A * 10/1985 Berfield ..... 15/327.2
4,569,100 A * 2/1986 Purkapile ..... 15/327.2
4,809,395 A * 3/1989 Fleischhauer ..... 15/327.2
5,131,114 A * 7/1992 Sunagawa et al. ..... 15/323
5,144,716 A * 9/1992 Watanabe et al. ..... 15/323
5,440,780 A * 8/1995 Rakocy et al. ..... 15/327.2
5,555,600 A * 9/1996 Corson ..... 15/327.2
6,345,411 B1 * 2/2002 Kato et al. ..... 15/DIG. 1

FOREIGN PATENT DOCUMENTS

| | | |
|---|---|---|
| EP | 734678 | 10/1996 |
| FR | 954126 | 12/1949 |
| FR | 1310618 | 3/1963 |
| JP | 06105769 | 4/1994 |

OTHER PUBLICATIONS

European Search Report dated Jun. 22, 2001, application No. EP01104778.

* cited by examiner

*Primary Examiner*—Theresa T. Snider
(74) *Attorney, Agent, or Firm*—RatnerPrestia

(57) ABSTRACT

An electric cleaner provided with a main body comprised of a cleaner housing (20) equipped with wheels (27) for mobility on a floor surface. Both side surfaces of the main body extend outwardly beyond rim portions (35) of the respective wheels (27) that stay in contact with the floor surface, and a center of gravity G (40) of the main body is placed in such a position that the main body rolls toward a direction where the wheels (27) stand on the floor surface so as to return itself into an original posture when the main body tilts in a way that one of the side surfaces lies in contact to the floor.

37 Claims, 34 Drawing Sheets

ELECTRIC VACUUM CLEANER

FIELD OF THE INVENTION

The present invention relates to an electric cleaner used in an ordinary household.

BACKGROUND OF THE INVENTION

1. First Prior Art

FIG. 32 and 33 depict an example of an electric cleaner of the prior art. As shown in FIG. 32, a cleaner housing 1 and a suction nozzle 2 are connected with a hose 3 and an extension pipe 4. As illustrated in FIG. 33, there are arranged an electric blower chamber 6, which houses an electric blower 5 for generating suction force, and a cord-reel chamber 9, which houses a cord reel 8 storing a power supply cord 7, in juxtaposition with respect to each other within the cleaner housing 1. There is also a dust chamber (not shown in the figure) for collecting dust, formed in front of the electric blower chamber 6. The cleaner housing 1 is provided with wheels 10 on both sides of it for mobility. The cleaner housing 1 is also provided with a laterally rotatable caster (not show in the figure) on a bottom surface of it at a forward side of the wheels 10. The cleaner housing 1, the wheels 10 and the caster comprise a main body. In such a structure of the prior art, however, there were occasionally cases in which the main body loses its balance and turns sideways if one of the wheels 10 rides over an obstacle such as a cushion, when the main body is being moved by pulling it with the hose 3. This imposed on the user an inconvenience of setting up the main body at each time.

2. Second Prior Art

FIG. 34 shows another example of an electric cleaner of the prior art. As shown in FIG. 34, a suction nozzle 2 and a cleaner housing 13 are connected with an extension pipe 4 and a hose 3. Wheels 11 having a diameter larger than the cleaner housing 13 are mounted on both sides of the cylindrically shaped cleaner housing 13. The cleaner housing 13 and the wheels 11 comprise a main body 12. The cleaner housing 13 is so constructed that it does not project toward the floor surface beyond rims of the wheels 11. In this structure of the prior art, however, the cleaner could be immobilized if caught by a chair or the like between one of the wheels 11 and the hose 3 when the main body 12 was being pulled with the hose 3. Or, the cleaner could lie with a side of the wheel 11 on the floor surface once it toppled sideways, and it was therefore not easy to handle. In addition, this structure required upsizing of the main body 12, since a span between the wheels 11 needs to be widened in order to house an electric blower 5 for suctioning dust, a power supply cord 7 for supplying electric power to the electric blower 5, and so on, within the cleaner housing 13, and a diameter of the wheels 11 needs to be enlarged beyond that of the cleaner housing 13 so as to improve stability against toppling.

SUMMARY OF THE INVENTION

The present invention is intended to obviate the aforesaid problems of the prior art, and it aims at providing an electric cleaner that is small in size, light weight, and easy to handle.

To achieve the above object, a cleaner of this invention comprises: a main body provided with a cleaner housing containing an electric blower for generating suction force and a pair of wheels mounted on the cleaner housing for mobility on a floor surface; a suction nozzle for suctioning dust on the floor surface to be cleaned through an extension pipe and a hose with the suction force of the electric blower; and a dust chamber located in a portion along an air passage from the suction nozzle to the electric blower for collecting dust, wherein both side surfaces of the main body extend outwardly beyond rim portions of the respective wheels that stay in contact with the floor surface, and that a center of gravity of the main body is placed in such a position that the main body rolls toward a direction where the wheels stand on the floor surface so as to return itself into an original posture when the main body careens in a way that one of the sides lies on the floor. Accordingly, the invention realizes the electric cleaner that is not easily toppled, and returns into its normal posture even if it turns sideways.

DESCRIPTION OF THE PREFERRED EMBODIMENTS

First Exemplary Embodiment

Figure 1:
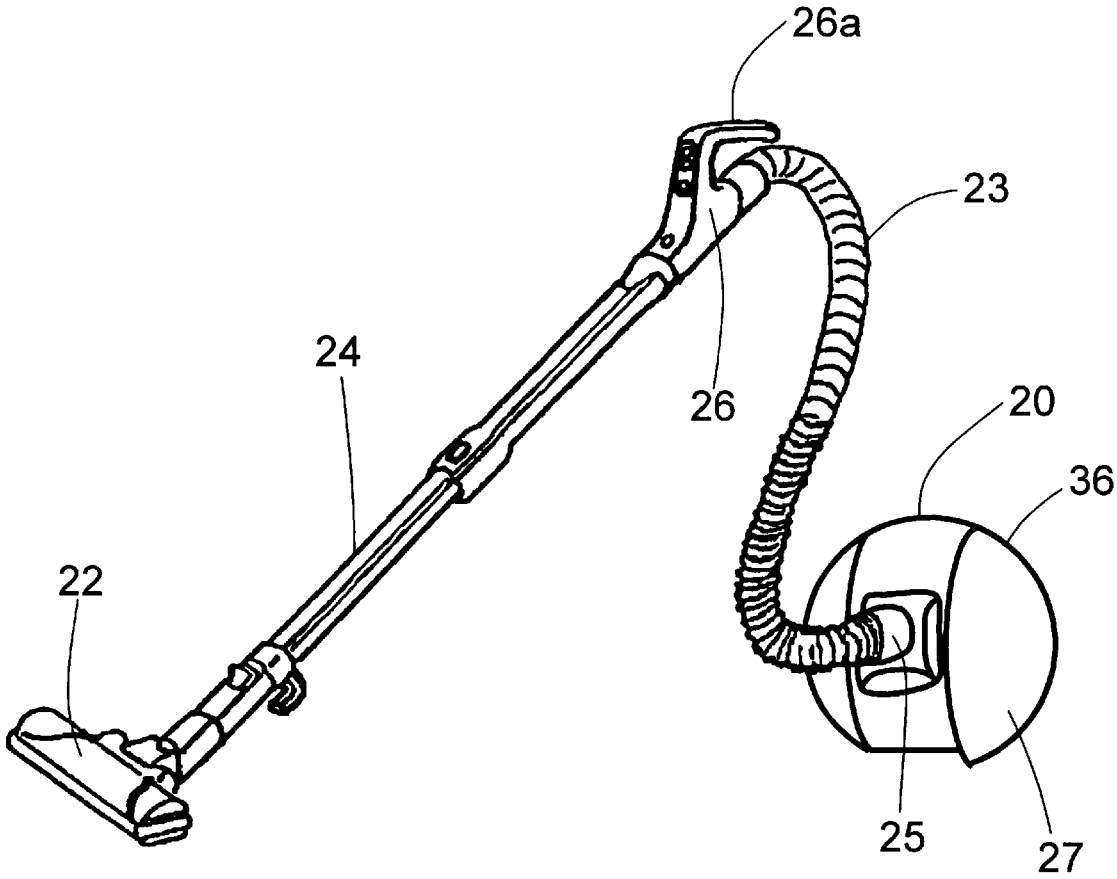
FIG. 1 is a perspective view of an electric cleaner of a first exemplary embodiment of the present invention.
Figure 2:
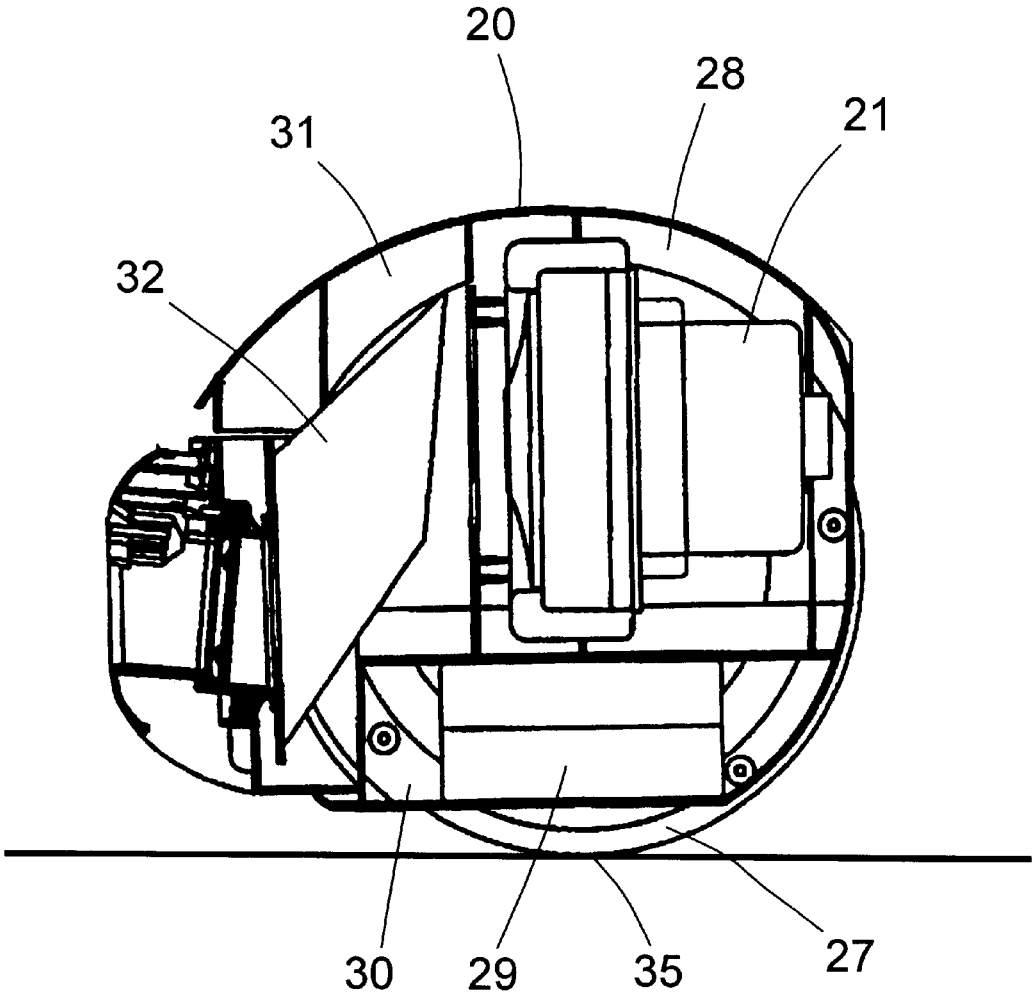
FIG. 2 is a sectioned side view of a main body of the same cleaner.

In FIG. 1 and FIG. 2, a cleaner housing 20 houses an electric blower 21, which generates suction force. The cleaner housing 20 is connected to a suction nozzle 22 with an extension pipe 24 and a hose 23 for suctioning dust on a floor surface. Thus, the suction force produced by the electric blower 21 acts upon the suction nozzle 22 through the hose 23 and the extension pipe 24, so as to suck dust from an intake port provided at a bottom of the suction nozzle 22. The hose 23 is provided with a connector pipe 25 at one end, which is detachably connectable to the cleaner housing 20, and an end pipe 26 having a grip handle 26*a* at another end, which is also detachably connectable to one end of the extension pipe 24. The suction nozzle 22 can be moved back and forth through the extension pipe 24 by repeating a push-and-pull motion while holding the grip handle 26*a* above the end pipe 26 with a hand. The cleaner housing 20 has wheels 27 mounted rotatably on both sides of it for ease of mobility. The cleaner housing 20 and the wheels 27 compose a main body 36. The connector pipe 25 and the end pipe 26 attached at both ends of the hose 23 are each equipped with a revolving mechanism to retain the hose 23 in a freely rotatable manner for 360 degrees. In other words, the revolving mechanism can release the hose 23 from a twisting strain, which occurs while cleaning by holding the grip handle 26*a* on the end pipe 26.

As shown in FIG. 2, the cleaner housing 20 is provided with an electric blower chamber 28 in its upper rear section for housing the electric blower 21, and a battery chamber 30 in its lower rear section for housing batteries 29. Dust passed through the hose 23 is collected in a dust bag 32 placed removably in a dust chamber 31 located in front of the electric blower chamber 28. In this exemplary embodiment, although the dust bag 32 for collecting dust is placed in the cleaner housing 20, it can be located anywhere along an air passage from the suction nozzle 22 to the electric blower 21. Some of examples where a dust room can be located for collecting dust include the extension pipe 24 and the end pipe 26. No problem shall arise regardless of the presence or absence of the dust bag 32, or even if a configuration of the dust chamber 31, and so on are altered.

Figure 3:
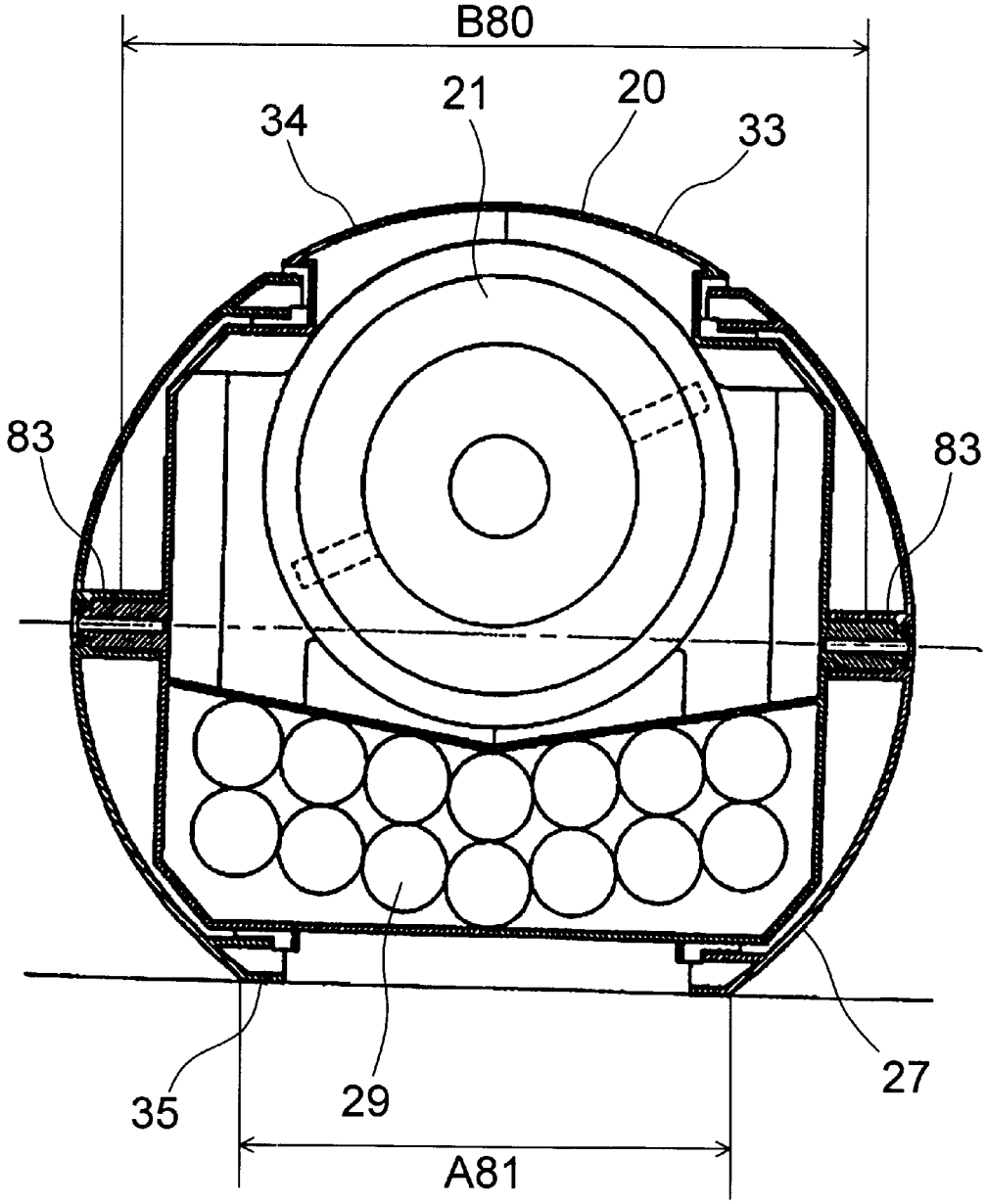
FIG. 3 is a cross sectional view of the main body of the same cleaner.

The cleaner housing 20 is comprised of two divided sides, a right case 33 and a left case 34, so that the electric blower 21 and the batteries 29 are retained between the right case 33 and the left case 34, as shown in FIG. 3. Although the cleaner housing 20 shown in this exemplary embodiment is a structure divided laterally, it may be divided vertically. All that is required, is to retain the electric blower 21 and the batteries 29 in it. A distance "B" 80 between bearings 83 located at rotational center of the both wheels 27 is designed to be longer than a distance "A" 81 between rim portions 35 of the respective wheels 27 that stay in contact with the floor, since the wheels 27 are generally spherical in shape. As the main body of the cleaner has a generally spherical shape, the right case 33, the left case 34, and the wheels 27 are all generally spherical in their collective outer appearance.

Because the distance "A" 81 between the rim portions 35 of the wheels 27 in contact with the floor is shorter than a width of the cleaner's main body, as shown in FIG. 3, a rotational resistance produced between the rim portions 35 and the floor surface is small when the cleaner's main body is moved. In addition, an impactive force received by the rim portions 35 of the wheels 27, when the cleaner's main body is dropped from above the floor to the floor, is transferred to the bearings 83 only after it is alleviated by a momentary deformation in spherical outer shape of the wheels 27, thereby preventing the bearings 83 from being cracked and otherwise damaged.

Figure 4:
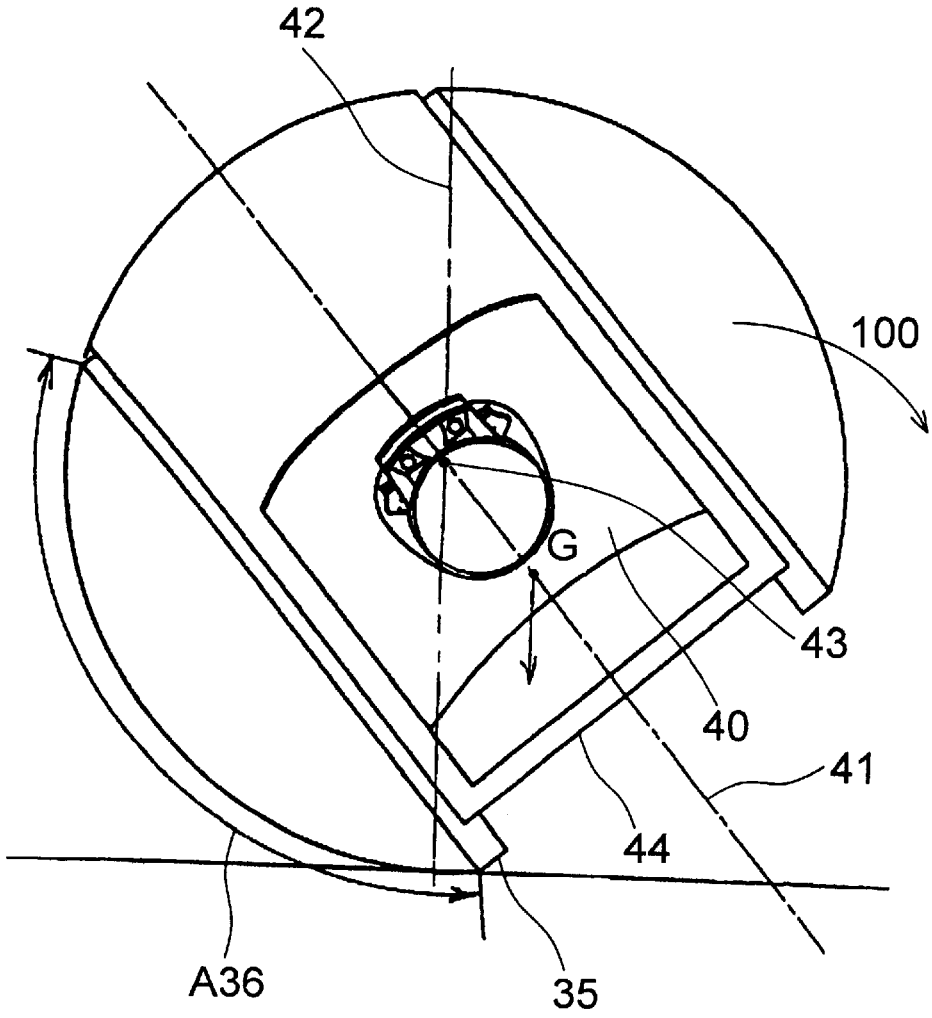
FIG. 4 is a front view of the main body of the same cleaner as it is tilted sideways.
Figure 5:
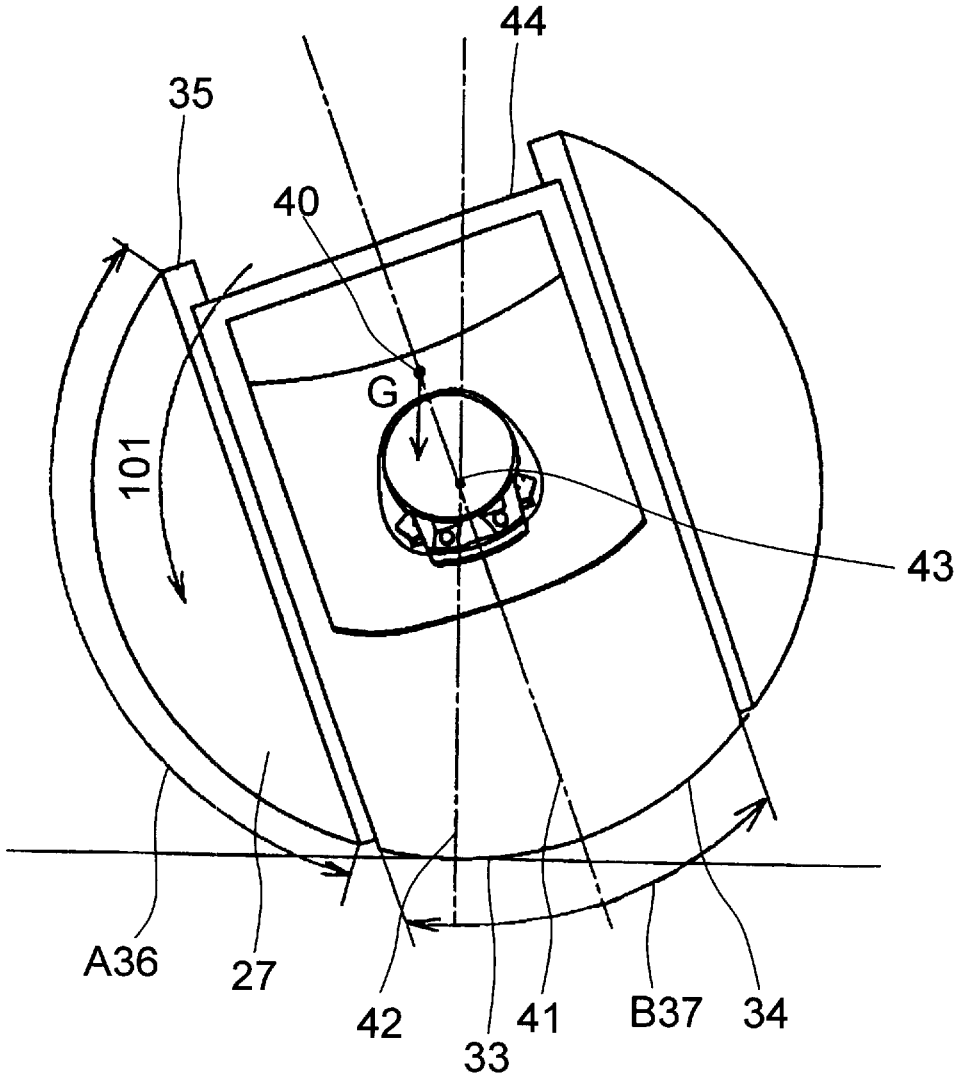
FIG. 5 is a front view of the main body of the same cleaner when it is turned upside down.
Figure 6:
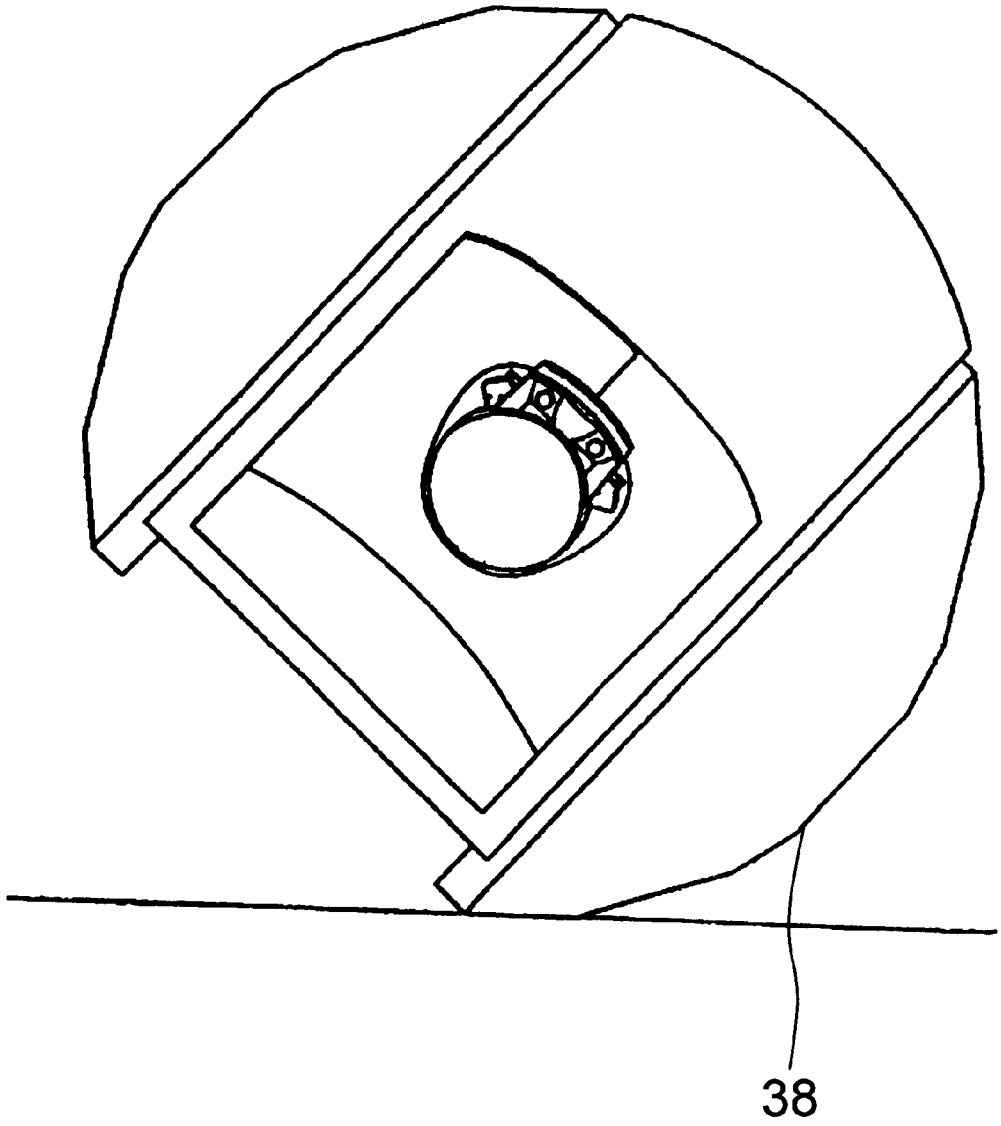
FIG. 6 is another front view of the main body of the same cleaner as it is tilted sideways.
Figure 7:
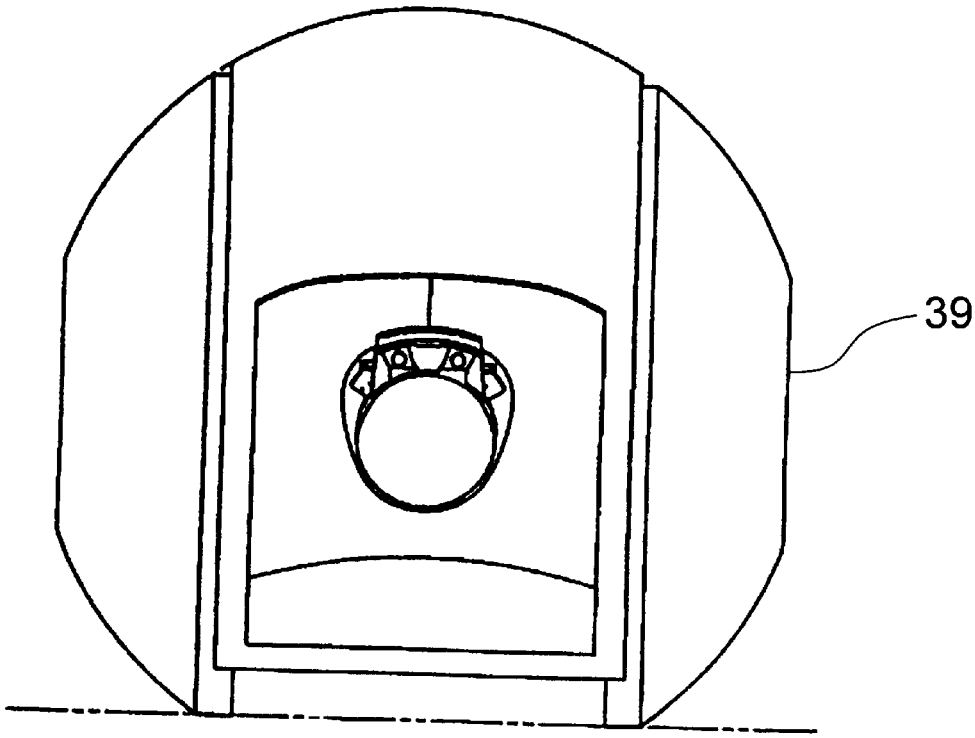
FIG. 7 is another front view of the main body of the same cleaner.

FIG. 4 is a front view of the main body as it is tilted sideways, and FIG. 5 is another front view of the main body when it is turned upside down. As shown in these figures, the main body has side rolling surfaces A36 consisting of the hemispherical surfaces of the wheels 27 projecting sideward beyond the rim portions 35, and an upper rolling surface B37 consisting of the spherical upper surface. The side rolling surfaces A36 and the upper rolling surface B37 need not only be spherical in shape, but they may be a polyhedral rolling surface 38, or have a flat surface 39 in part, such as those shown in FIG. 6 and FIG. 7. In short, they need to have the rolling surface at least partly in their respective surfaces.

In this invention, a center of gravity "G" 40 of the main body is arranged to be in a position closer to a bottom side surface 44 than a point 43 where a center line 41 of the main body intersects with a normal line 42 drawn from a tangent point of the main body to the floor surface, as shown in FIG. 5. The position of center of gravity "G" 40 creates a rotational moment in the main body that inclines the main body to regain its original posture. This original posture is where the rim portions 35 of the wheels 27 stand on the floor. As such, when the main body tilts sideways in a manner that any of the side rolling surfaces A36 and the upper rolling surface B37 comes in contact with the floor surface, the main body rolls in a direction of an arrow 100 without turning sideways, as shown in FIG. 4. Because of the position of the center of gravity "G" 40, when either one of the wheels 27 is lifted off the floor surface as shown in FIG. 4, the main body will roll in a direction of an arrow 100, and the rim portions 35 of the wheels 27 stand again on the floor. Further, the main body rolls in a directions of an arrow 101, and the rim portions 35 of the wheels 27 stand again on the floor, even when it turns upside down, as shown in FIG. 5, since the center of gravity "G" 40 is in the position as shown in the figure.

Figure 8:
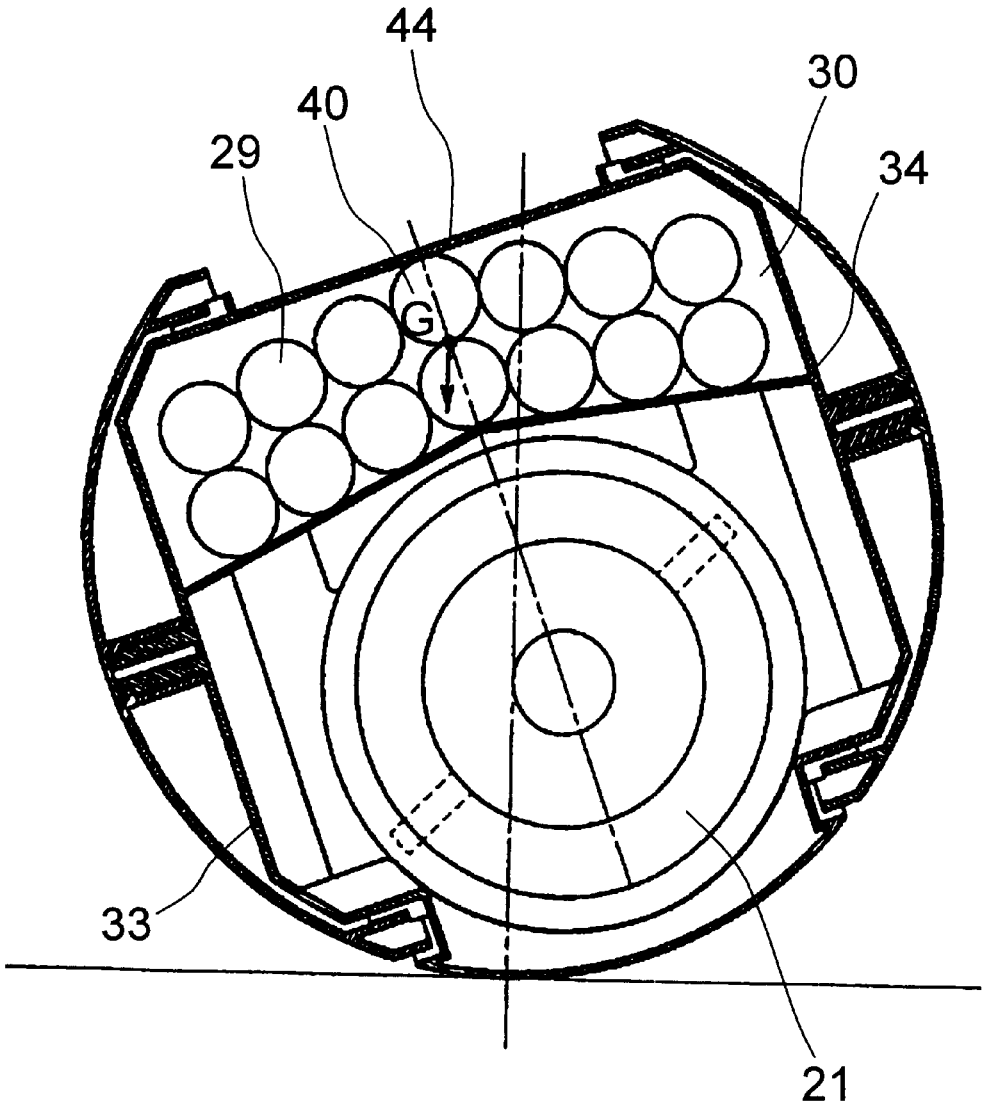
FIG. 8 is a cross sectional view of the main body of the same cleaner when it is turned upside down.

A structure in which the center of gravity "G" 40 is placed in the position closer to the bottom side surface 44 can be achieved easily by arranging the batteries 29 disposed in the bottom side surface 44 to be heavier in mass than the electric blower 21, as shown in FIG. 8, without necessitating an installation of other weights, etc. Furthermore, since the right case 33 and the left case 34 comprising the cleaner housing are arranged in a manner to project into spaces inside of the wheels, a wide battery chamber 30 is provided in a widthwise direction, thereby allowing more batteries 29 to be stored. This also ensures a sufficient exhaust space so as to allow efficient passage of the exhaust air beside the electric blower 21 in the electric blower chamber 28. Moreover, since either one or both of the connector pipe 25 and the end pipe 26 are freely rotatable with respect to the hose 23, the main body can roll to resume its original posture without turning sideways when it is tilted, and no strain is ever imposed on a hand of the user due to twisting of the hose 23 held by the hand, even if the main body turns sideways. Moreover, the main body needs not be restrictive to the spherical shape, but a cylindrical shape is also suitable, so long as it has a rolling surface at least partly in the side surface for recovering the normal posture when it is tilted.

Figure 9:
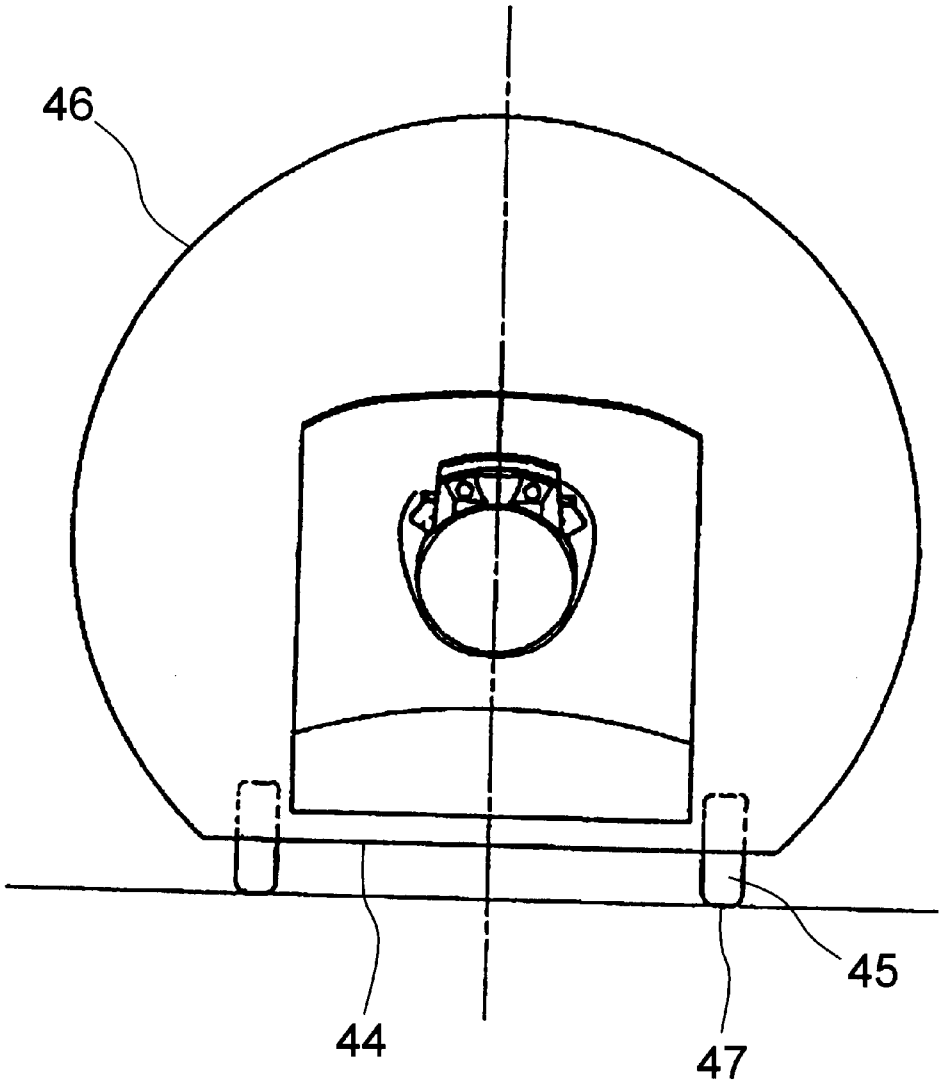
FIG. 9 is still another front view of the main body of the same cleaner.

FIG. 9 is another example of this exemplary embodiment. Wheels 45 project from the bottom surface 44. A margin of projection of the wheels 45 is designed such that the main body can roll over the wheels 45 without substantial impediment from the wheels 45, when it returns to the original posture from a position where a rolling surface 46 on its side rests on the floor surface 47. Because the structure of FIG. 9 carries the wheels 45 on the bottom surface 44, and thereby it realizes a reduction in outer diameter of the wheels, the main body can be made dimensionally more compact.

Figure 10:
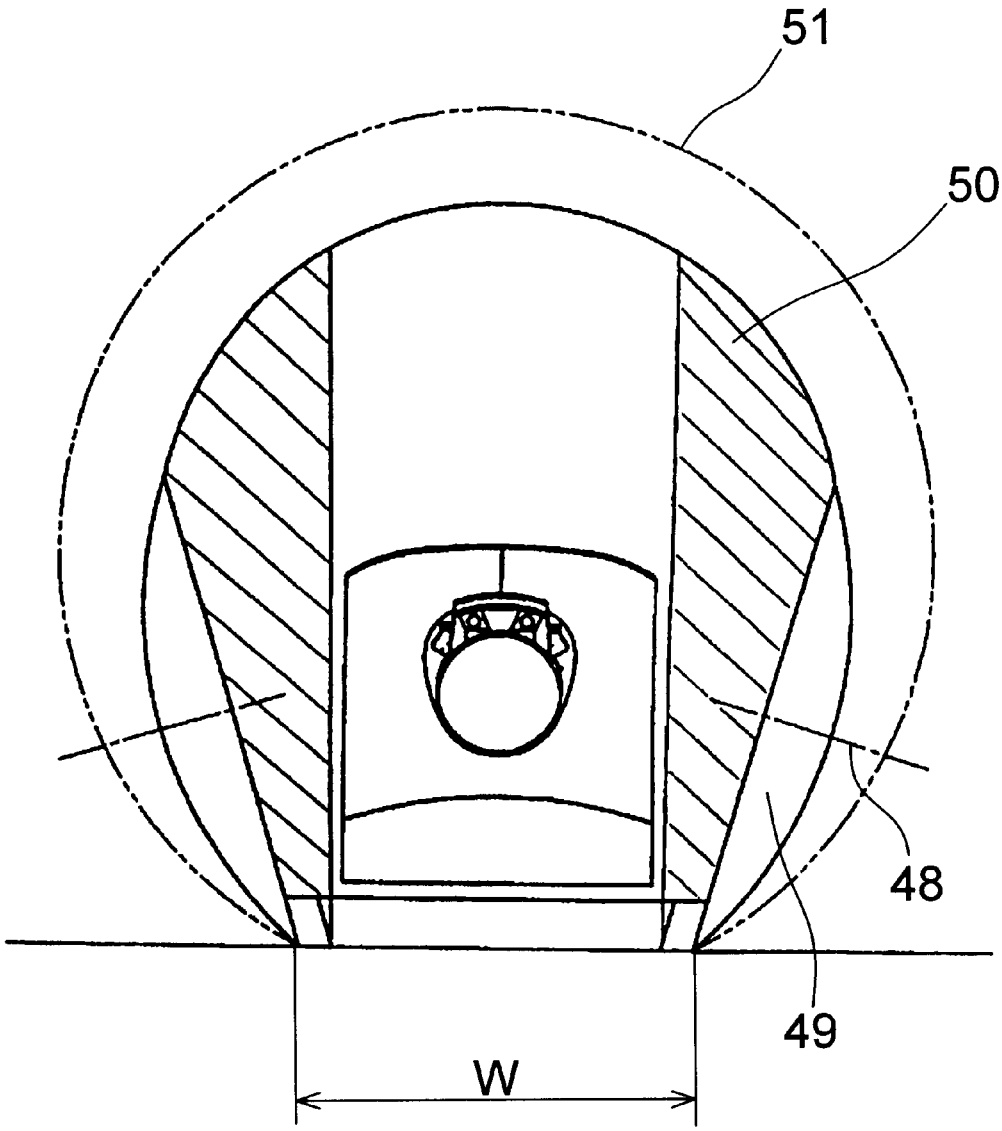
FIG. 10 is yet another front view of the main body of the same cleaner.
Figure 11:
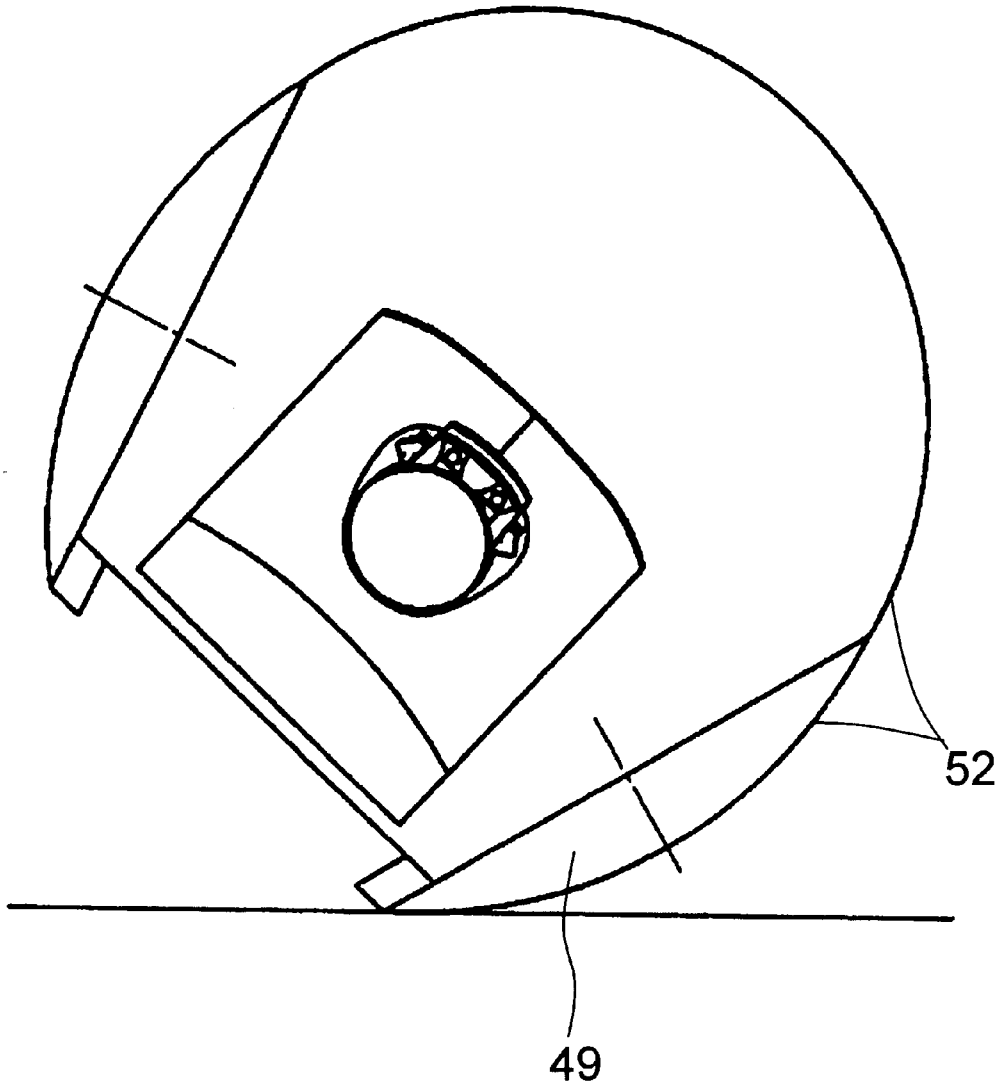
FIG. 11 is another front view of the main body of the same cleaner as it is tilted sideways.

FIG. 10 is still another example of this exemplary embodiment. In this example, wheels 49 of generally hemispherical shape or generally hemispherical polyhedron are positioned on both sides of the cleaner housing 20 with their rotational axes 48 canted upwardly with respect to the floor surface as viewed toward an inner direction. In the case of a cleaner equipped with horizontal rotational axes, wheels as large a size as hatched areas 50 are necessary in order to obtain a span "W" between the wheels (see also FIG. 3). Therefore, the main body becomes such a size as shown by a phantom line 51 in order to obtain an equivalent space within the cleaner housing 20 to that of this exemplary embodiment if the rotational axes are horizontal. The main body of a small size as this exemplary embodiment can be made possible with the canted rotational axes, because the hatched areas 50 can be used for additional space within the cleaner housing 20. In addition, the main body can even move about on a side surface of one of the wheels 49 if the main body tilts as shown in FIG. 11, or it can roll and return to the normal posture from the tilted position by taking advantage of a rolling surface 52 in contiguity with the wheels 49.

Figure 12:
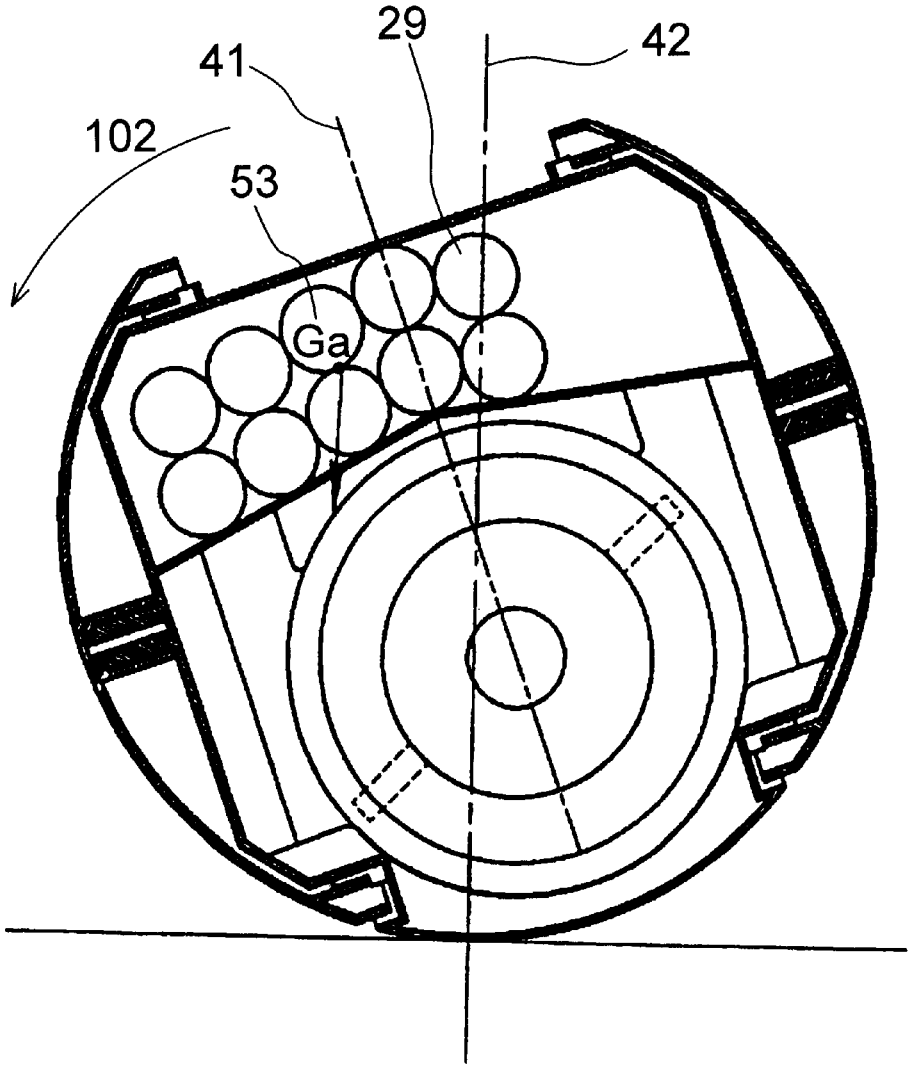
FIG. 12 is another cross sectional view of the main body of the same cleaner when it is turned upside down.

In FIG. 12, the center of gravity of the main body is shifted off the center line 41 by the structural arrangement in which a position of either single or a plurality or batteries 29 housed in the cleaner housing 20 is decentered. Naturally, the same can be achieved by decentering the electric blower 21 or the like. With the above structure, the main body always rolls toward a direction of an arrow 102 without failure even when it turns upside down into such a posture where a normal line 42 drawn from a tangent point of the main body comes closely in line with the center line 41, since a center of gravity "Ga" 53 of the batteries 29 is decentered with respect to the center line 41, and thereby the main body does not remain in the turned state.

Second Exemplary Embodiment

Figure 13:
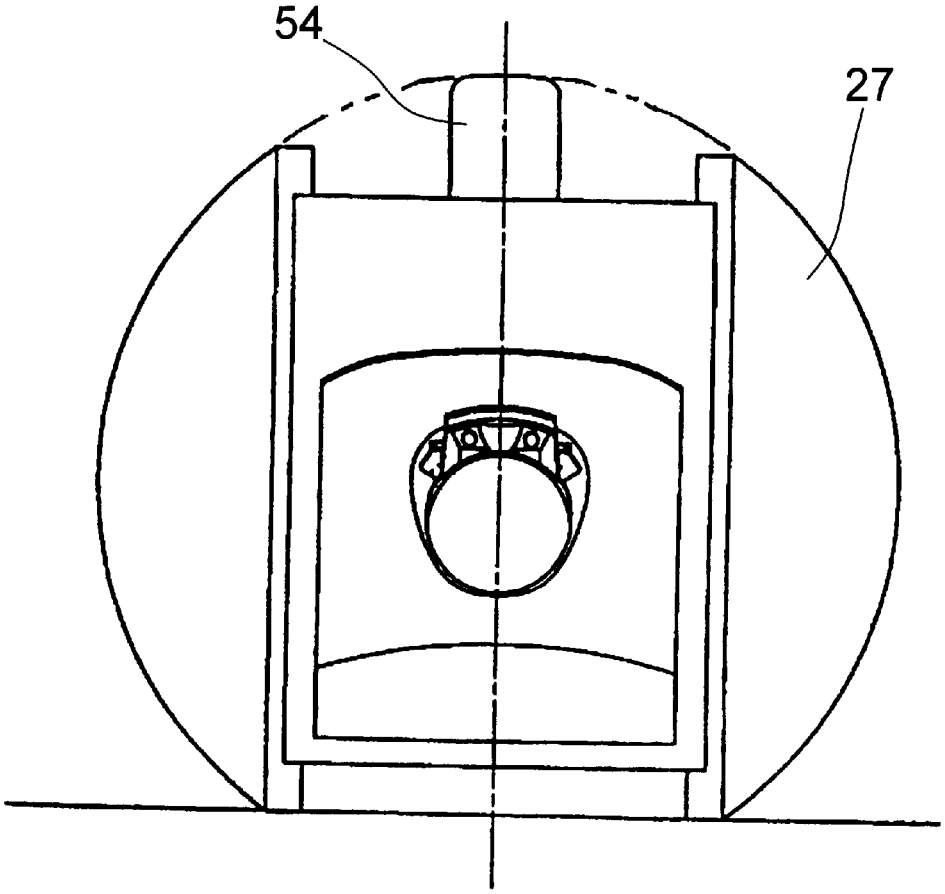
FIG. 13 is a front view of a main body of a cleaner of a second exemplary embodiment of the present invention.
Figure 14:
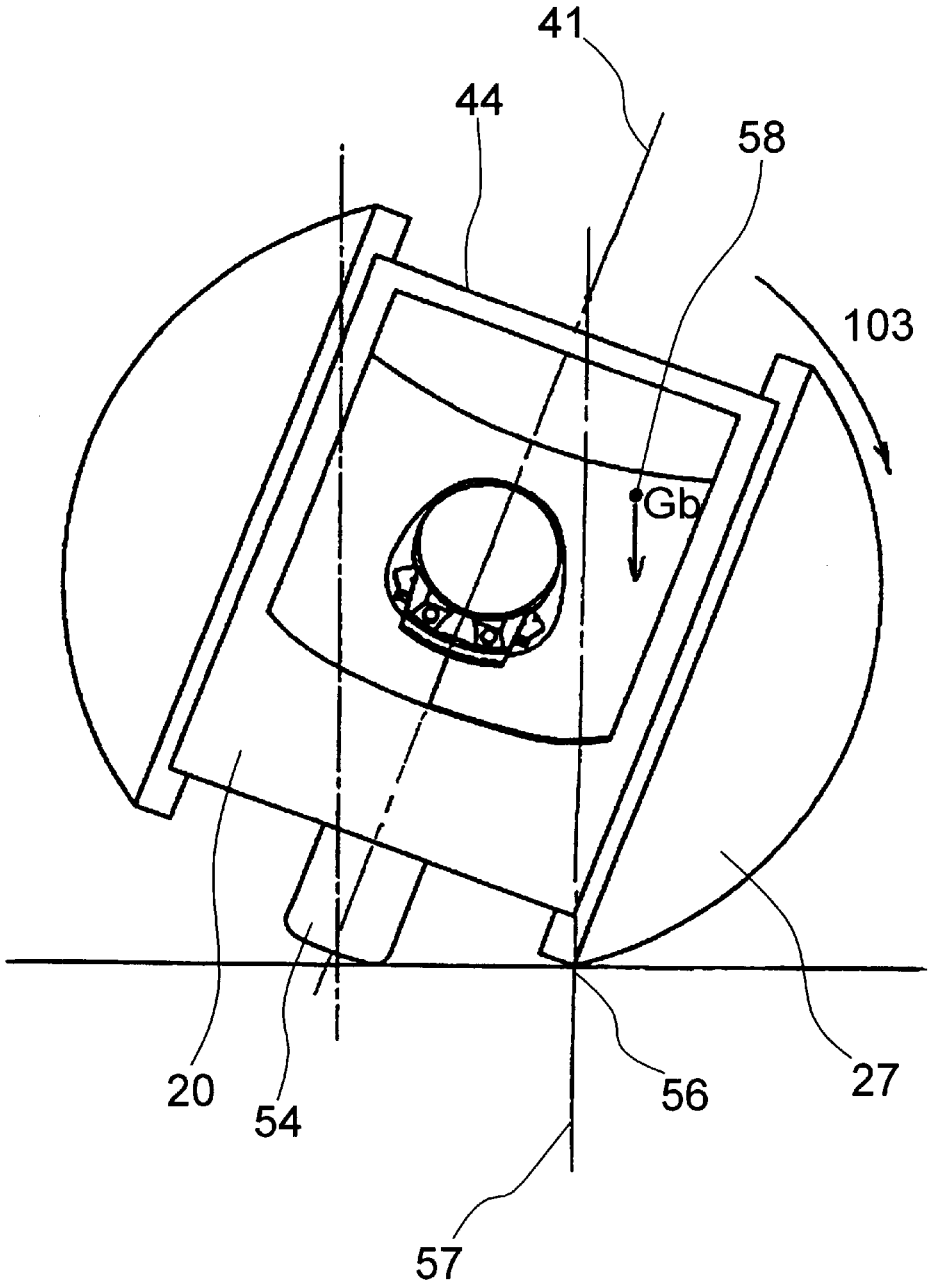
FIG. 14 is a front view of the main body of the same cleaner when it is turned upside down.

As shown in FIG. 13, a cleaner housing 20 is provided with a protrusion 54 on its upper part, and wheels 27 on both sides in a freely rotatable manner. The protrusion 54 may be a carrying handle of the cleaner. The protrusion 54 is so positioned that it closely forms a generally spherical exterior shape with the wheels 27. A center of gravity "Gb" 58 of the main body is placed in a position outside of a point where a perpendicular line 57 drawn from a floor contact point 56 of one of the wheels 27 intersects with a center line 41 of the main body, when the main body turns upside down into such a position as shown in FIG. 14, that it rests on the floor surface with the protrusion 54 and one of the wheels 27. In FIG. 14, the main body in the upside down state rolls in a direction of an arrow 103, with the contact point 56 acting as a fulcrum of the rolling. The wheels 27 can thus come back to their normal standing position on the floor.

Third Exemplary Embodiment

Figure 15:
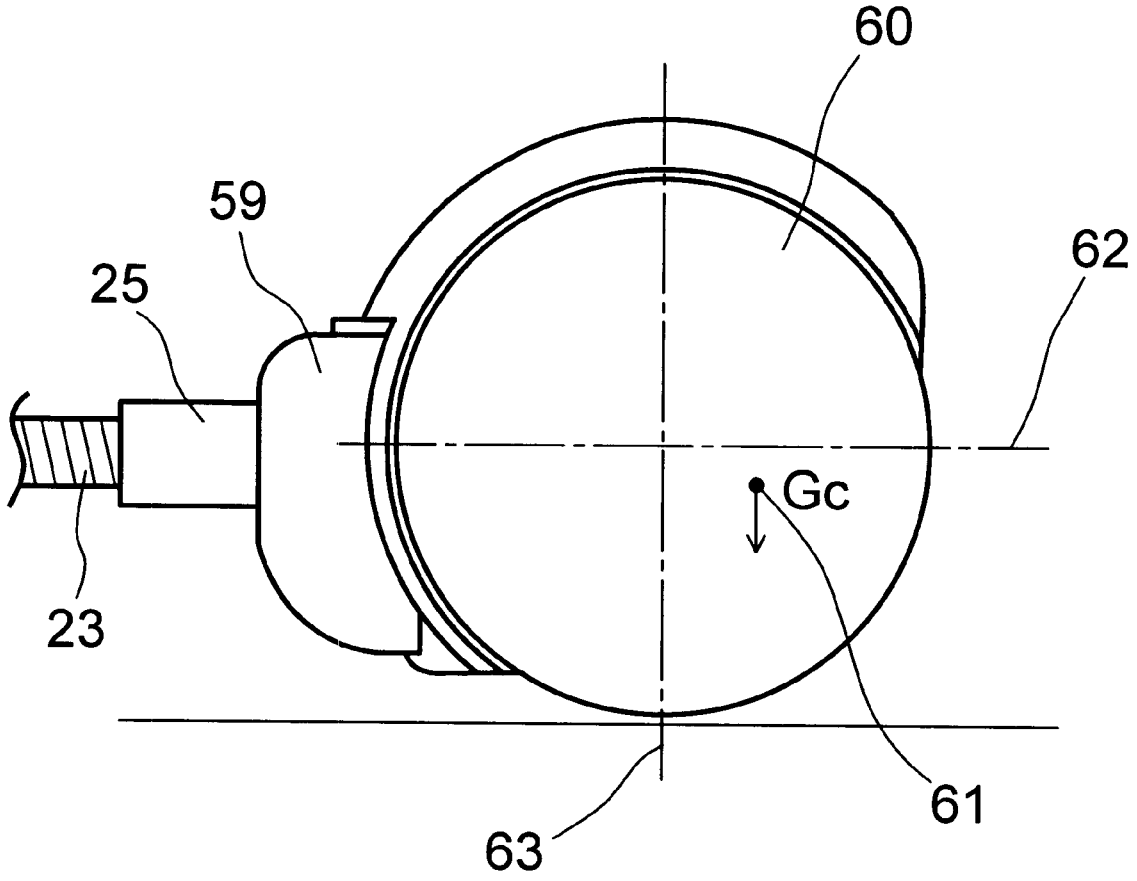
FIG. 15 is a side view of an electric cleaner of a third exemplary embodiment of the present invention.
Figure 16:
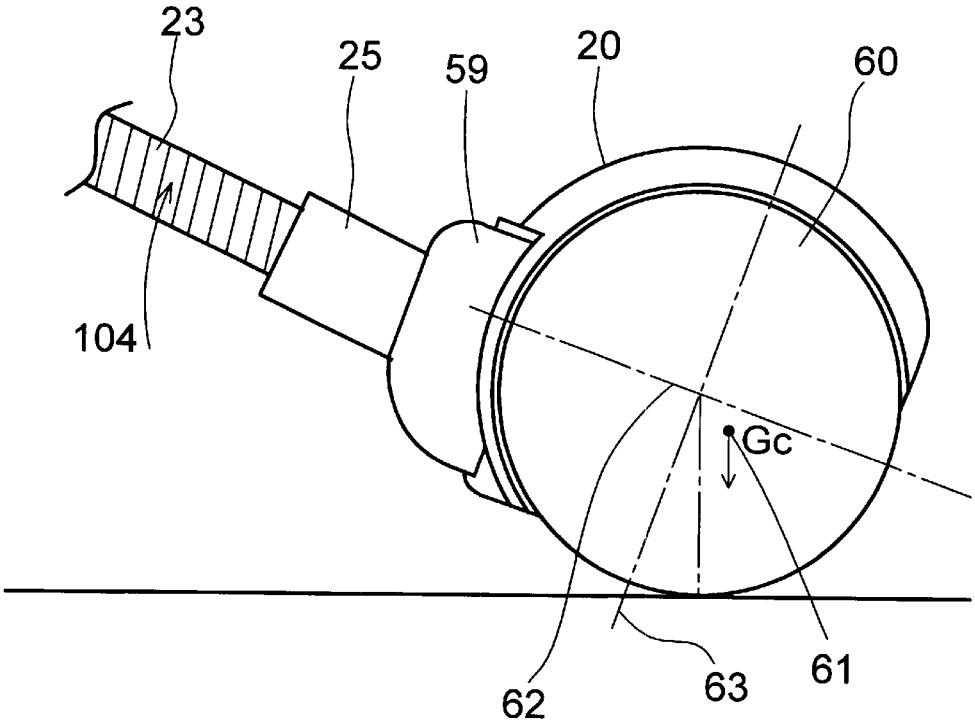
FIG. 16 is another side view of the same electric cleaner.

As shown in FIG. 15, there is a front cover 59 mounted onto a front part of the main body for detachably connecting a connector pipe 25 attached to one end of the hose 23. The main body is also provided with wheels 60 on both sides in a freely rotatable manner. A center of gravity "Gc" 61 of the main body is placed in a position lower than a horizontal line 62 of the wheels 60 and rearward of a vertical line 63. Because the center of gravity "Gc" 61 of the main body is placed rearward and downward of the wheels 60, the hose 23 tends to rise in a direction of an arrow 104, as shown in FIG. 16. This allows the main body to move smoothly without causing the hose 23, the cleaner housing 20 and the like being dragged on the floor when the main body is being moved. In addition, it helps a user to reconnect the hose 23 easily to the main body, since the front cover 59 rises in the direction of arrow 104 when the hose 23 is removed.

Fourth Exemplary Embodiment

Figure 17:
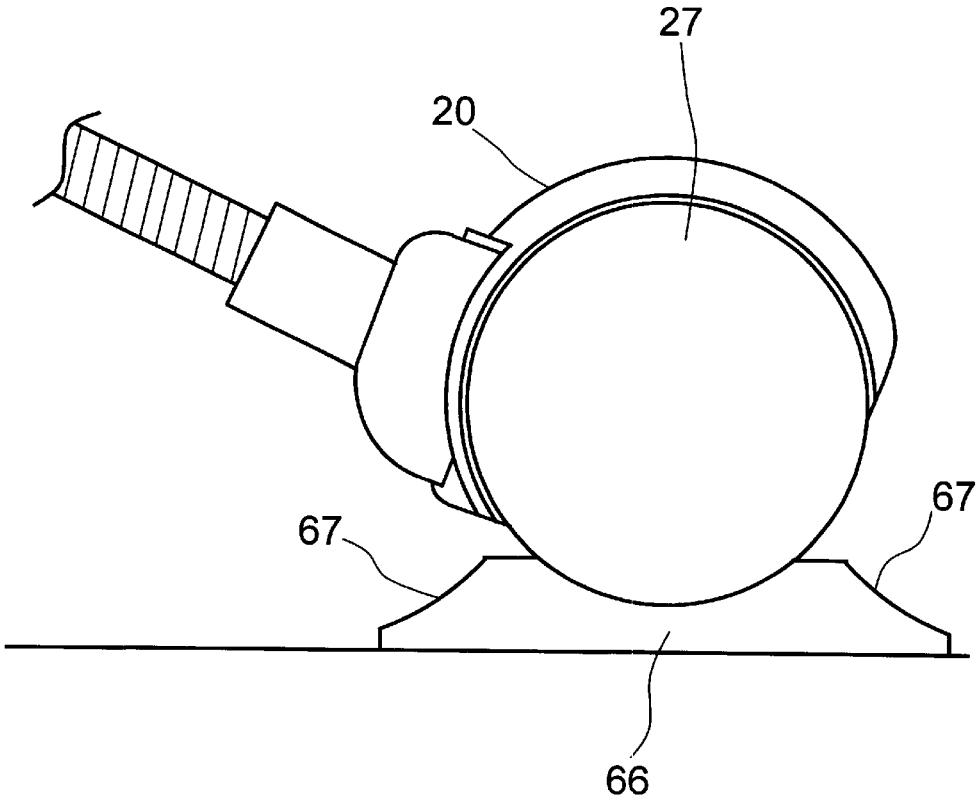
FIG. 17 is a side view of an electric cleaner of a fourth exemplary embodiment of the present invention.
Figure 18:
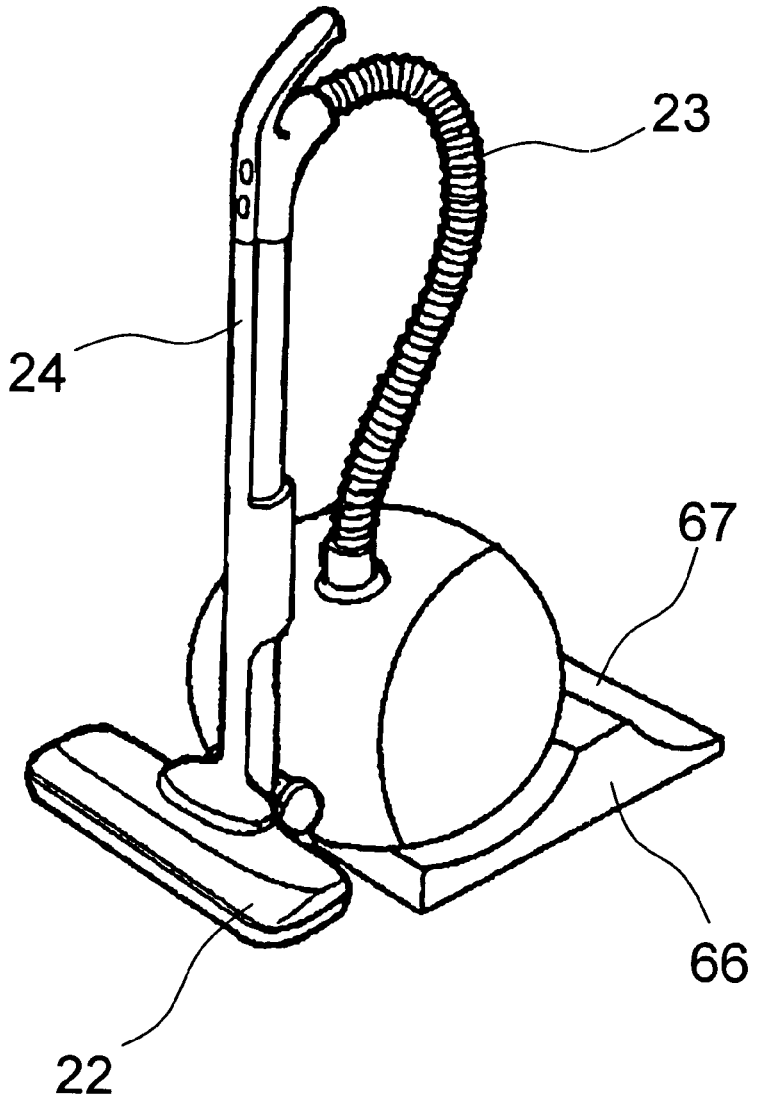
FIG. 18 is a perspective view of the same electric cleaner.

In FIG. 17, a cleaner housing 20 is equipped with an electric blower and a secondary battery (not show in the figure) which needs to be charged. A charge stand 66 is provided with guide alleys 67 for wheels 27 at both front and rear ends. A charge terminal (not show in the figure) of the cleaner housing 20 moved onto the charge stand 66 comes in contact with a charge terminal connector (not show in the figure) on the charge stand 66, and a charge to the secondary battery in the cleaner housing 20 begins. After the main body is moved along one of the guide alleys 67 and set in position on the charge stand 66, as shown in FIG. 18, it can be kept standing on the charge stand 66 with hose 23, extension pipe 24 and suction nozzle 22 left connected to the main body, and therefore the main body needs not be lifted while vacuum cleaning and when charging.

Fifth Exemplary Embodiment

Figure 19:
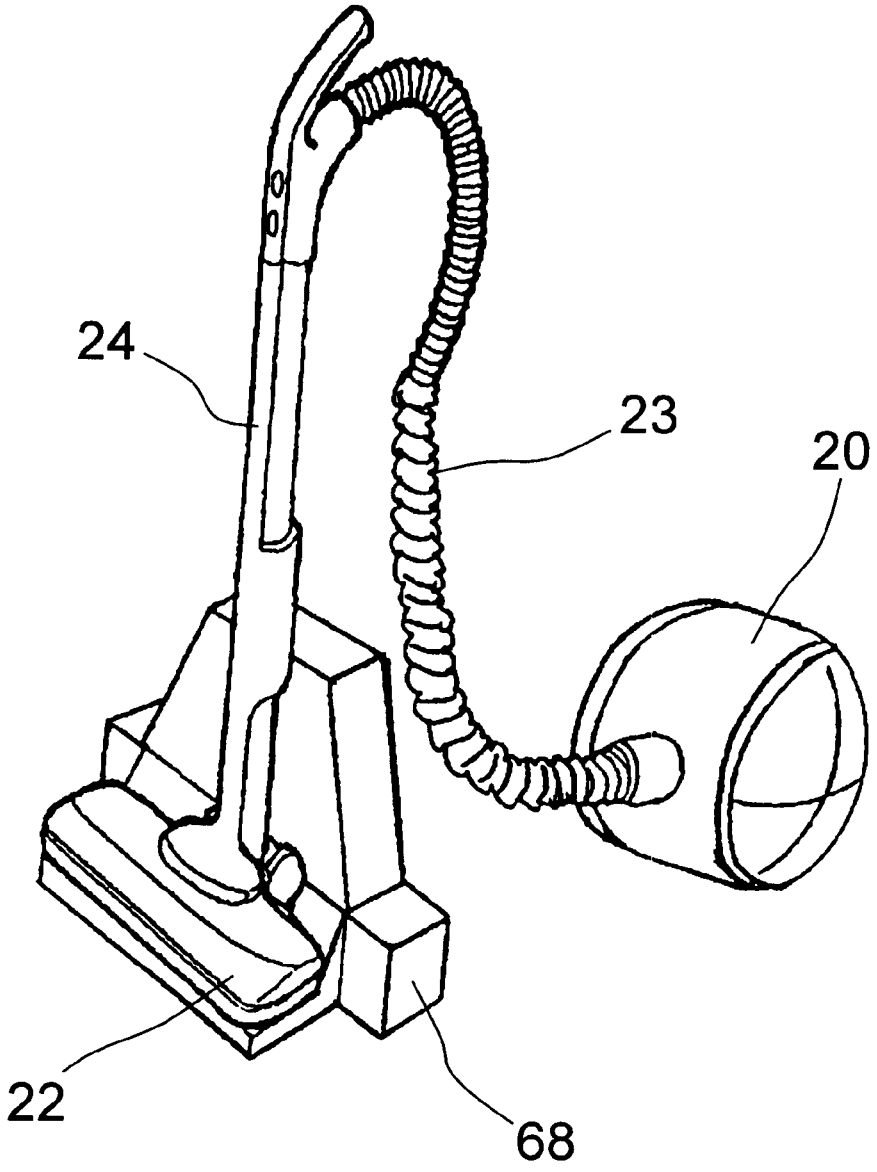
FIG. 19 is a perspective view of an electric cleaner of a fifth exemplary embodiment of the present invention.

In FIG. 19, a cleaner housing 20 is equipped therein with an electric blower and a secondary battery (not show in the figure) which needs to be charged. A suction nozzle 22 connected to a main body through a hose 23 and an extension pipe 24 is positioned in a detachable manner on a floor-use charge stand 68. A charge terminal (not show in the figure) in the suction nozzle 22 positioned on the floor-use charge stand 68 comes in contact with a charge terminal connector (not show in the figure) on the floor-use charge stand 68, and a charge to the secondary battery begins. Since the suction nozzle 22 is placed on the floor-use charge stand 68 with the hose 23 and the extension pipe 24 left connected to the main body, the main body needs not be lifted while cleaning and when charging.

Sixth Exemplary Embodiment

Figure 20:
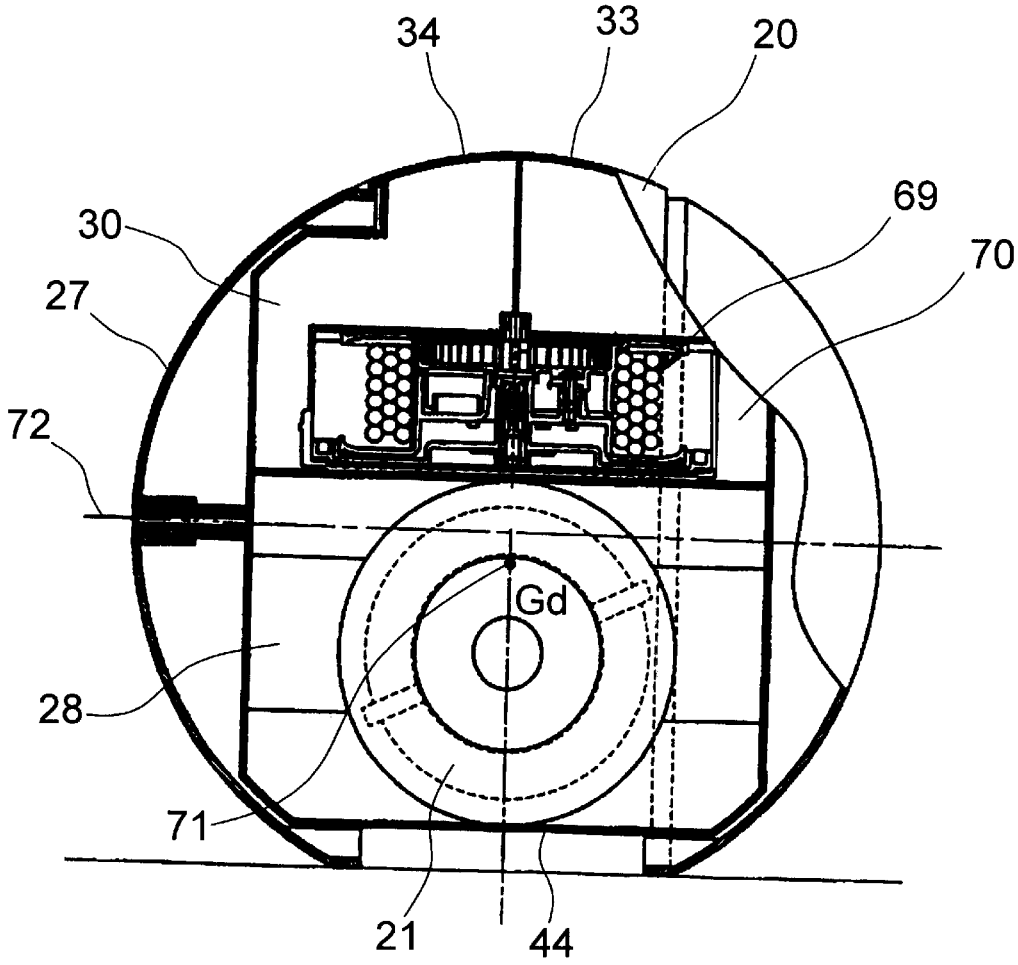
FIG. 20 is a cross sectional view of a main body of a cleaner of a sixth exemplary embodiment of the present invention.

In FIG. 20, a cleaner housing 20 consists of a right case 33 and a left case 34. An electric blower chamber 28 housing an electric blower 21, and a cord-reel chamber 70 housing a power supply cord 69 are provided within the cleaner housing 20. Wheels 27 are mounted rotatably on each side of the right case 33 and the left case 34. Under an initial state of use, in which the power supply cord 69 and the electric blower 21 are housed, a center of gravity "Gd" 71 of the main body is located below a rotational axis 72 of the wheels 27, near a bottom surface 44, in the same manner as the above-described first exemplary embodiment. In this exemplary embodiment, although the electric blower 21 is disposed at a side close to the bottom surface 44 below the cord-reel chamber 70, this structure may be reversed in its positional arrangement. The point is that the center of gravity "Gd" 71 needs to be arranged so as to keep it in the position shown FIG. 20. Since the center of gravity "Gd" 71 is placed in the same position as the first exemplary embodiment, the main body rolls back into the normal posture, when it tilts and comes to rest with a part of its rolling surface on the floor.

Figure 21:
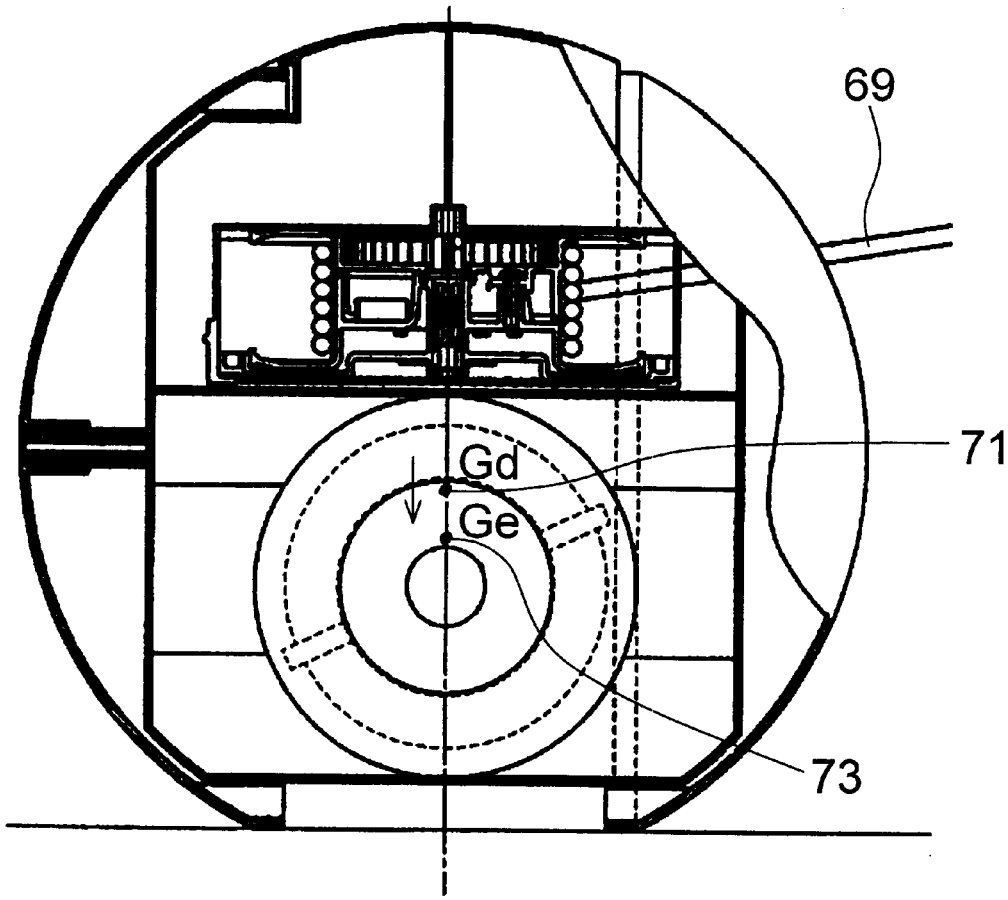
FIG. 21 is another cross sectional view of the main body of the same cleaner.

Moreover, the center of gravity shifts from the aforesaid position "Gd" 71 toward the bottom surface into a new position "Ge" 73, as shown in FIG. 21, due to a reduction in weight of the power supply cord 69 in the main body when the power supply cord 69 is pulled out of the main body. This lowers the center of gravity for further stability during movement, and makes the main body more unlikely to topple even if one of the wheels 27 runs on to an obstacle.

Figure 22:
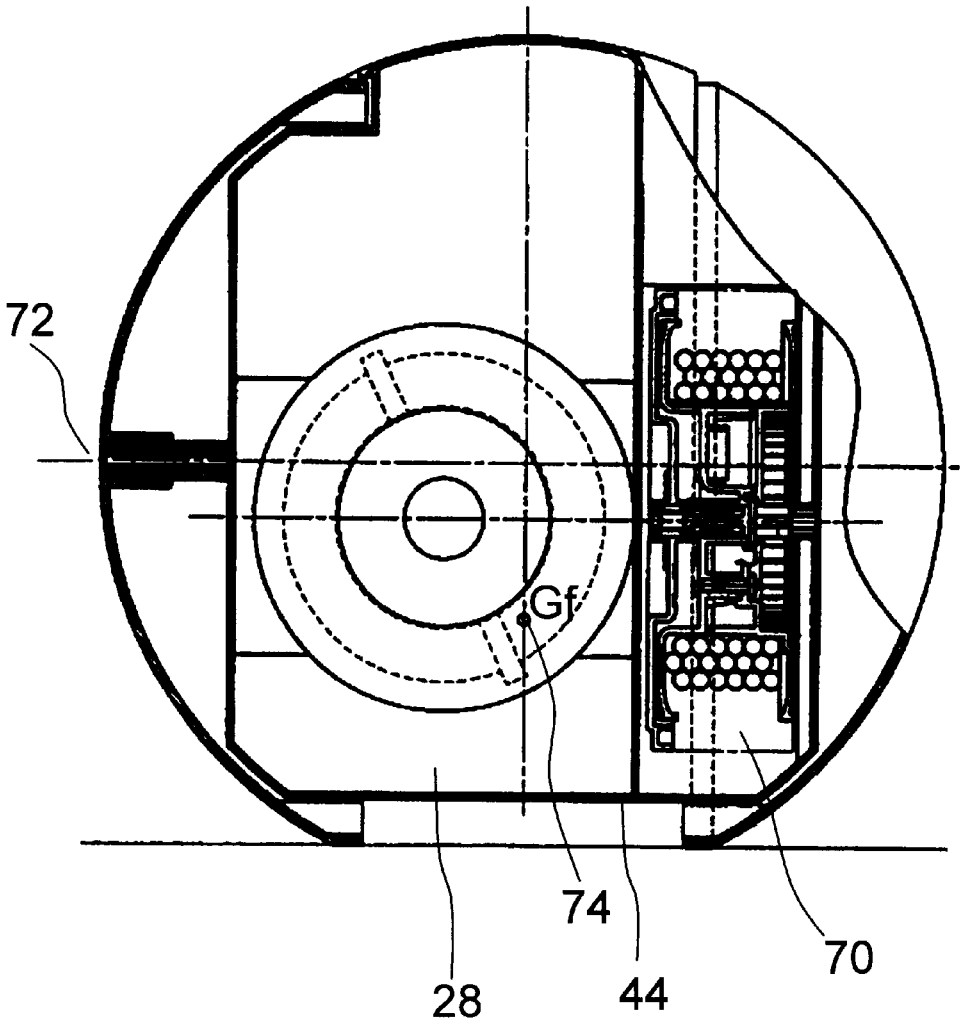
FIG. 22 is a cross sectional view of another main body of the same cleaner.
Figure 23:
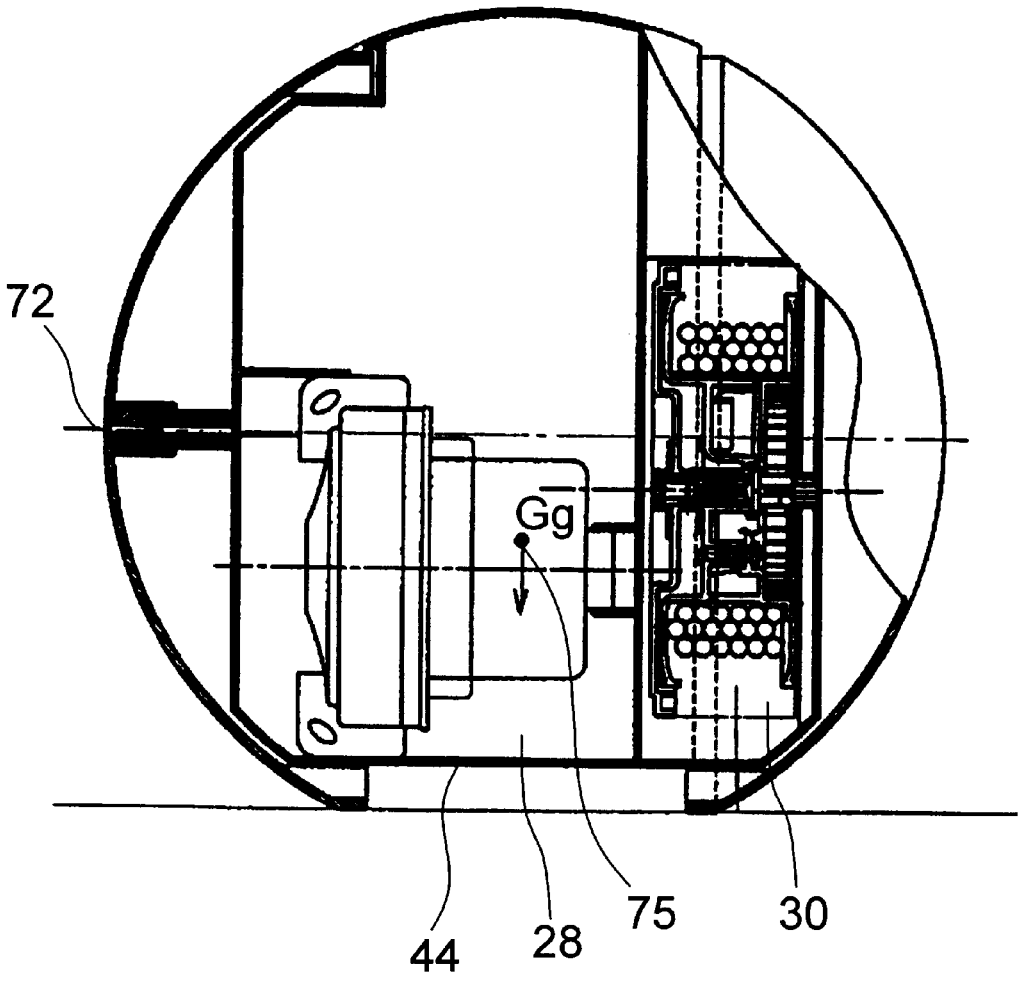
FIG. 23 is a cross sectional view of still another main body of the same cleaner.

FIG. 22 and FIG. 23 shows other structural arrangements of the electric blower chamber 28 and the cord-reel chamber 70. A center of gravity "Gf" 74 and another center of gravity "Gg" 75 are located near the respective bottom surfaces 44 off the rotational axes 72, in the same manner as the FIG. 20 shown above. Accordingly, the main body rolls back into the normal posture in the same manner as above, when it tilts and comes to rest with a part of its rolling surface on the floor. Also, the center of gravity can be lowered even further when the power supply cord 69 is pulled out.

Seventh Exemplary Embodiment

Figure 24:
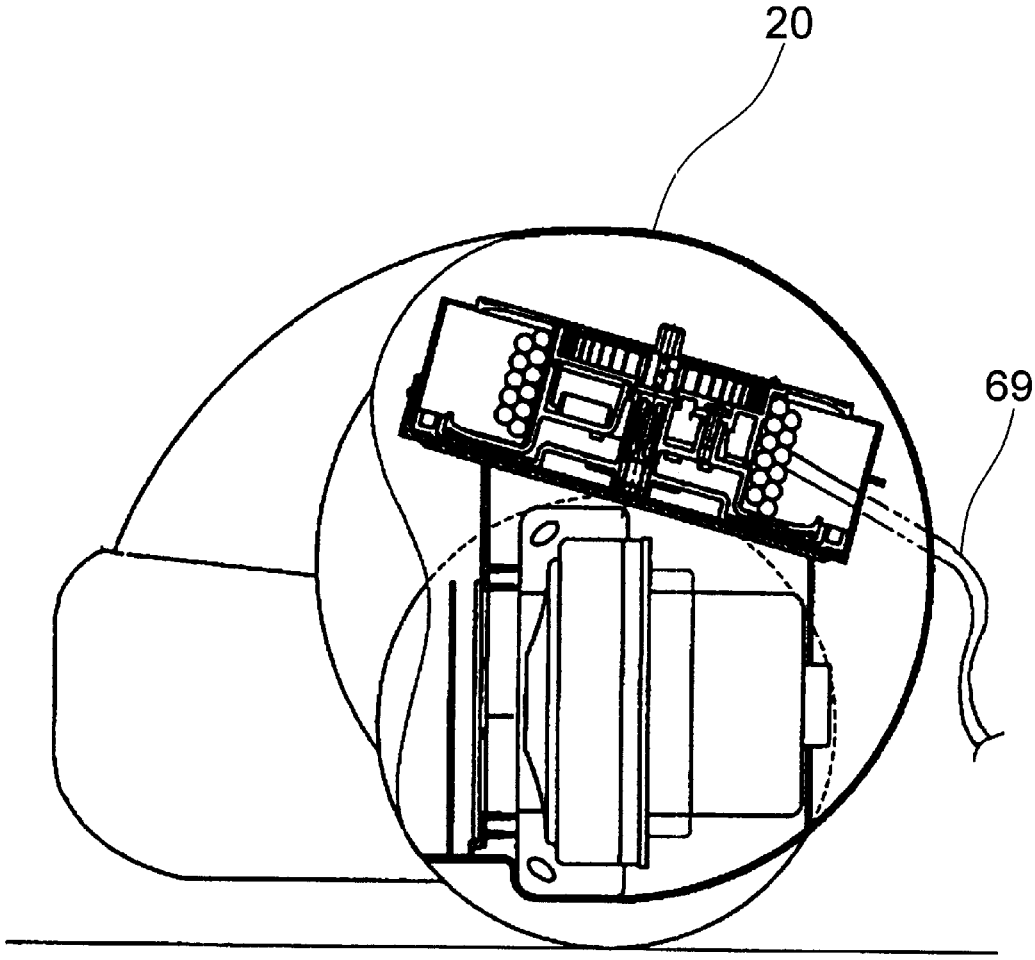
FIG. 24 is a partially sectioned side view of a main body of a cleaner of a seventh exemplary embodiment of the present invention.

In FIG. 24, a power supply cord 69 built into a main body is pulled out rearward from the main body. The main body does not run over the power supply cord 69 when the main body runs on to an obstacle or the like and turns sideways into an upside-down position, since the power supply cord 69 is pulled out behind the main body.

Figure 25:
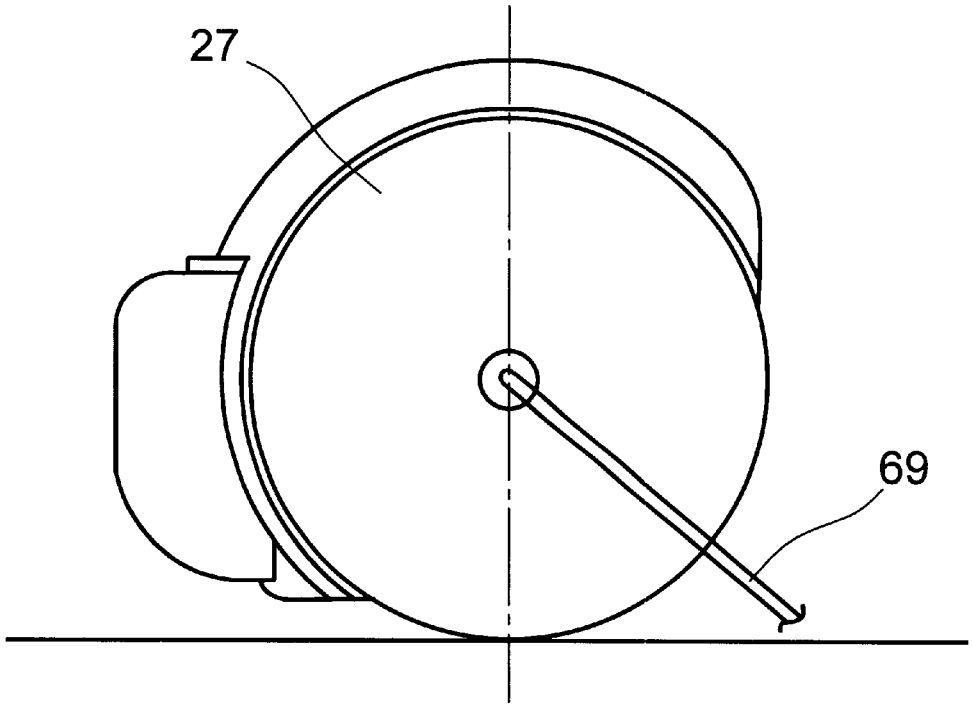
FIG. 25 is a side view of another main body of the same cleaner.

In another structure of FIG. 25, a power supply cord 69 is pulled out from near a center of one of the wheels 27. This makes the main body not likely to run over the power supply cord 69 while the main body is being moved and turned.

Eighth Exemplary Embodiment

Figure 26:
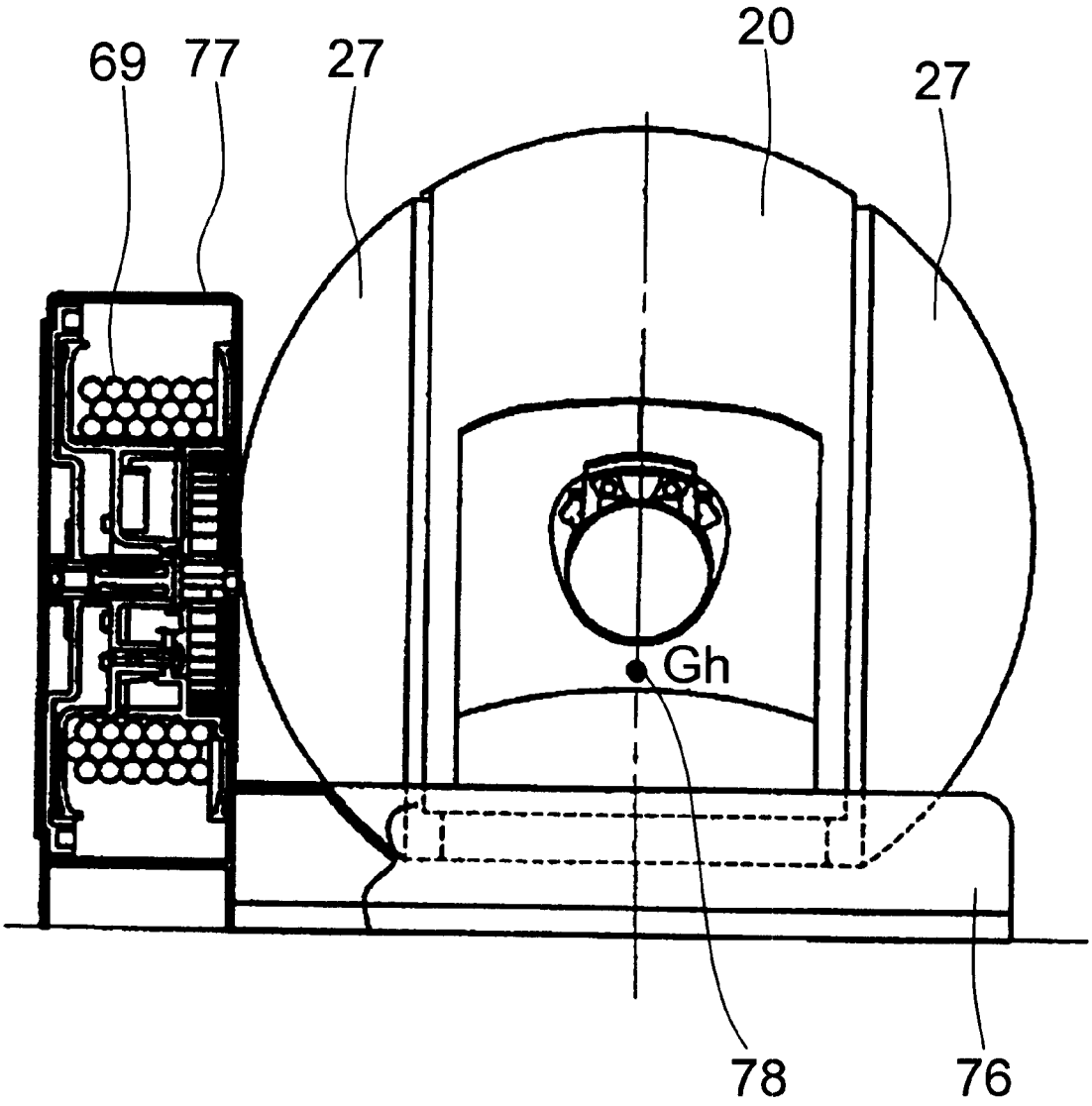
FIG. 26 is a partially sectioned front view of an electric cleaner of an eighth exemplary embodiment of the present invention.

In FIG. 26, a cleaner housing 20 is provided with an electric blower chamber therein to house an electric blower, and wheels 27 retained on both sides in a freely rotatable manner. A storage stand 76 for securely supporting a main body, when not in use, is equipped with a cord reel stand 77 which houses a power supply cord 69. One end of the power supply cord 69 is held fixed to the main body. Since the cord reel stand 77 is placed out of the interior of the main body, the electric blower 21 is the only heavy subject of adjustment for a center of gravity "Gh" 78 of the main body, thereby facilitating the adjustment of the center of gravity.

Ninth Exemplary Embodiment

Figure 27A:
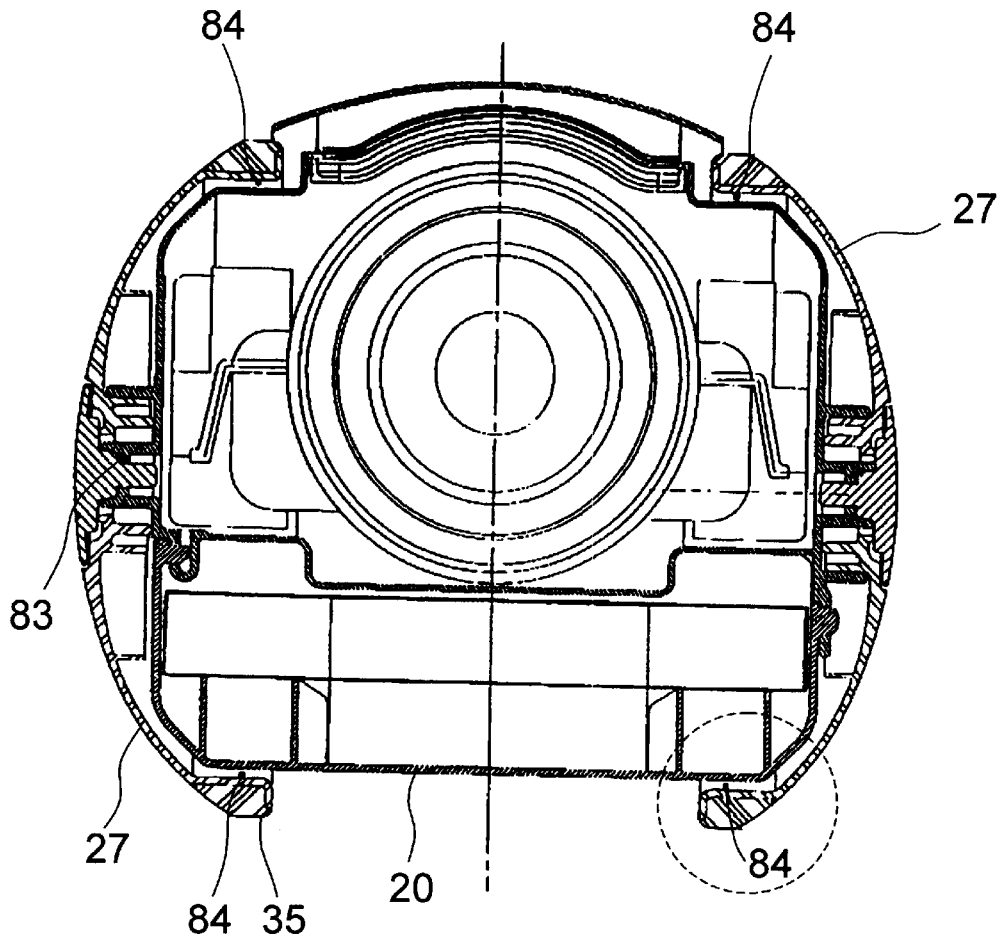
FIGS. 27A-B is a cross sectional view of a main body of a cleaner of a ninth exemplary embodiment of the present invention.
Figure 27B:
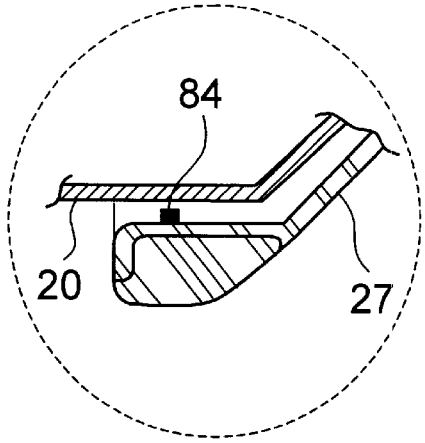

An exterior of a main body is configured to be generally spherical as shown in FIG. 27, and at least a part of the spherical exterior is composed of a pair of wheels 27 for traveling. A distance between bearings 83 of the wheels 27 is longer than a distance between rim portions 35 of the respective wheels that stand in contact with the floor, and slide members 84 capable of supporting the weight of the main body are provided between the respective rim portions 35 of the wheels and the cleaner housing 20. The slide members 84, formed of a material with a frictional resistance lower than that of the material composing the wheels 27, are mounted in place and fixed with adhesive or the like. When the main body is dropped from the above floor surface to the floor surface, an impactive force received by the rim portions 35 of the wheels 27 is transferred from the rim portions 35 of the wheels 27 to the main body via the slide members 84 disposed behind the wheels 27. Hence, the impactive force is not delivered directly to the bearings 83 of the wheels 27, thereby preventing damages to the bearings 83, such as cracks, and the like. Furthermore, since the slide members 84 are formed of the material having a lower frictional resistance than the material composing the wheels 27, the wheels 27 do not lose their rotatability even if the wheels 27 deform temporarily to cause the slide members 84 to hit the main body 20 when the main body is being turned to a different direction, or pulled over a surface that is not level.

Tenth Exemplary Embodiment

Figure 28:
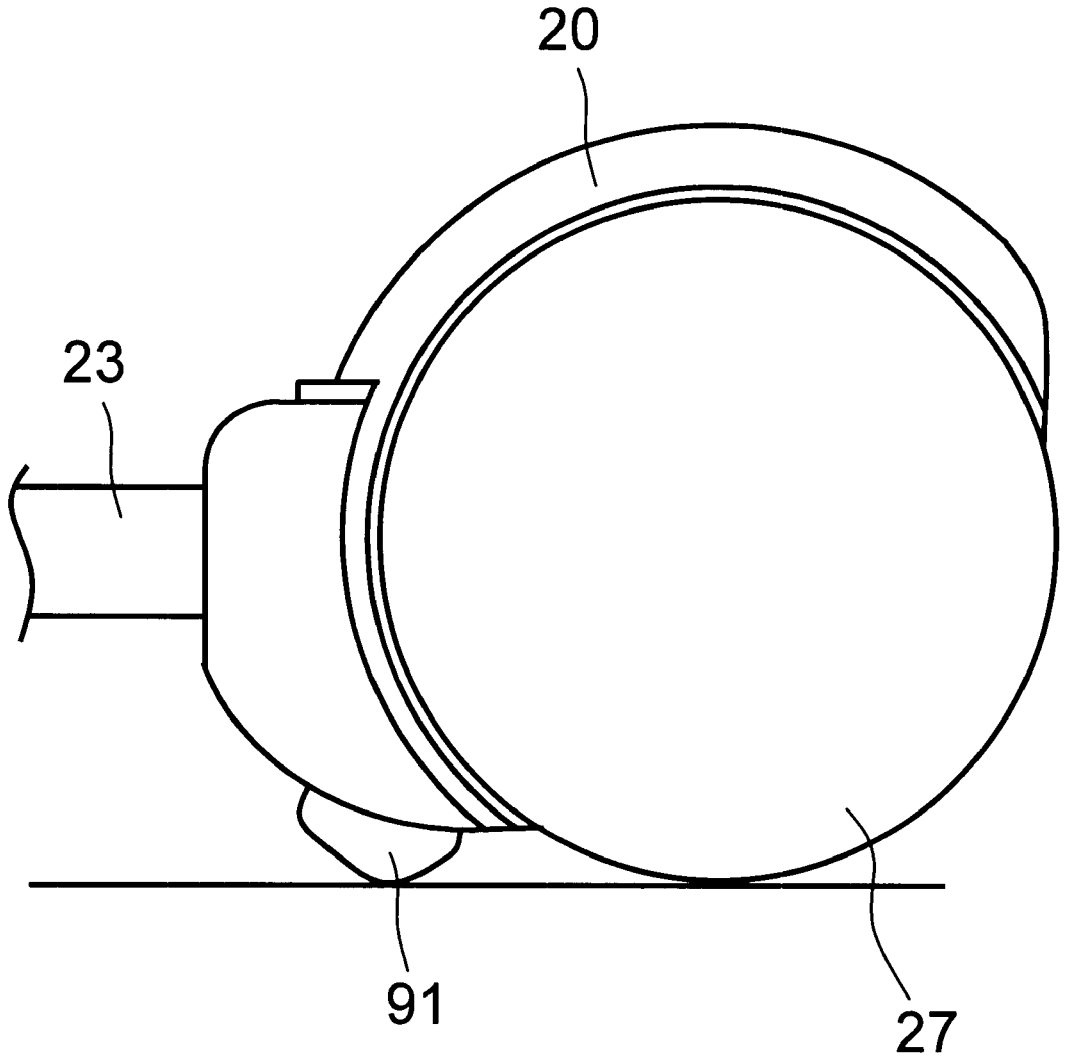
FIG. 28 is a side view of an electric cleaner of a tenth exemplary embodiment of the present invention.
Figure 29:
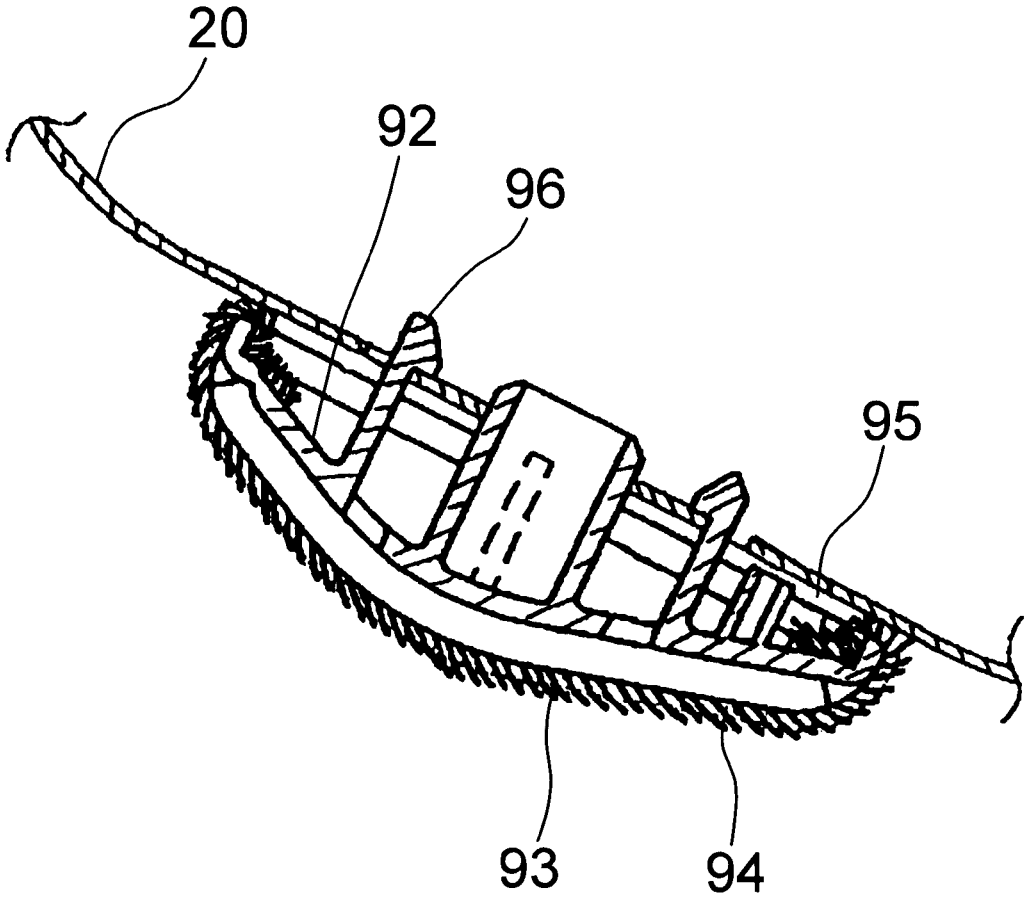
FIG. 29 is a longitudinal sectional view of a portion of a main body of the same cleaner.

A main body is provided with two wheels 27 at right and left sides of its rear portion, and a protuberance 91 on a front bottom surface, as shown in FIG. 28. The protuberance 91 is composed of a support frame 92, a piece of raised fabric 93 and polyurethane foam 94, as shown in FIG. 29. The polyurethane foam 94 is placed between the support frame 92 and the raised fabric 93. Both ends 95 of the raised fabric 93 are folded into places between the cleaner housing 20 and the support frame 92, and welded or bonded to the support frame 92. Alternatively, the raised fabric 93 may be folded and securely fixed to a bottom surface of the cleaner housing 20 with the support frame 92. The support frame 92 is retained by fitting a pawl 96 in the bottom surface of the cleaner housing 20, so that a leaning direction of nap of the raised fabric 93 is oriented toward a rear end of the main body during assembly. The protuberance 91 is mounted so that it rests on a surface to be cleaned when the main body is left standing, however, only the wheels 27 stay in contact with the surface being cleaned when the main body is being moved. The foregoing structure prevents unpleasant sounds such as rotating noise, rubbing noise, and the like that otherwise occur from a caster cover, a caster roller, and so on, when the main body is moved and turned in various directions. The raised fabric 93 and the polyurethane foam 94 absorb impacts, alleviate noises, and avoid scratches on the surface being cleaned even when the protuberance 91 is slid over the floor surface being cleaned. In addition, since the leaning nap of the raised fabric 93 is oriented toward the rear end of the main body, it can reduce a contact resistance with the surface being cleaned, and prevent the protuberance 91 from being tripped up by the surface being cleaned.

Because the ends 95 of the raised fabric 93 are folded behind the support frame 92, the ends 95 are not readily visible, making it rather attractive. The main body is very light and is quite easy to use and to manipulate because only the wheels 27 are in motion during manipulation. Although what has been described in this exemplary embodiment is an example of the protuberance 91 in which the support frame 92 is retained in the bottom surface of the cleaner housing 20 with the pawl 96, a tip end of the protuberance 91 may be formed of a soft material such as thermoplastic elastomer by two-material molding with a component that forms the bottom surface of the cleaner housing 20, as a matter of course. Alternatively, the protuberance 91 may be formed by bonding a cushioning material such as raised fabric, unwoven cloth, plain fabric, foam material, and the like on the bottom surface of the cleaner housing 20. In this exemplary embodiment, the protuberance 91 is so composed that the polyurethane foam 94 is placed between the support frame 92 and the raised fabric 93, and both ends 95 of the raised fabric 93 are folded into places between the cleaner housing 20 and the support frame 92. However, the raised fabric 93 can be substituted by a cushioning material such as unwoven cloth, plain fabric, foam material, and the like, to achieve a similar advantage as described above. In addition, it is needless to mention that the same advantage as described above can also be achieved without doubt even if the polyurethane foam 94 located between the support frame 92 and the raised fabric 93 is replaced with any other cushioning member of different foam material.

Eleventh Exemplary Embodiment

Figure 30:
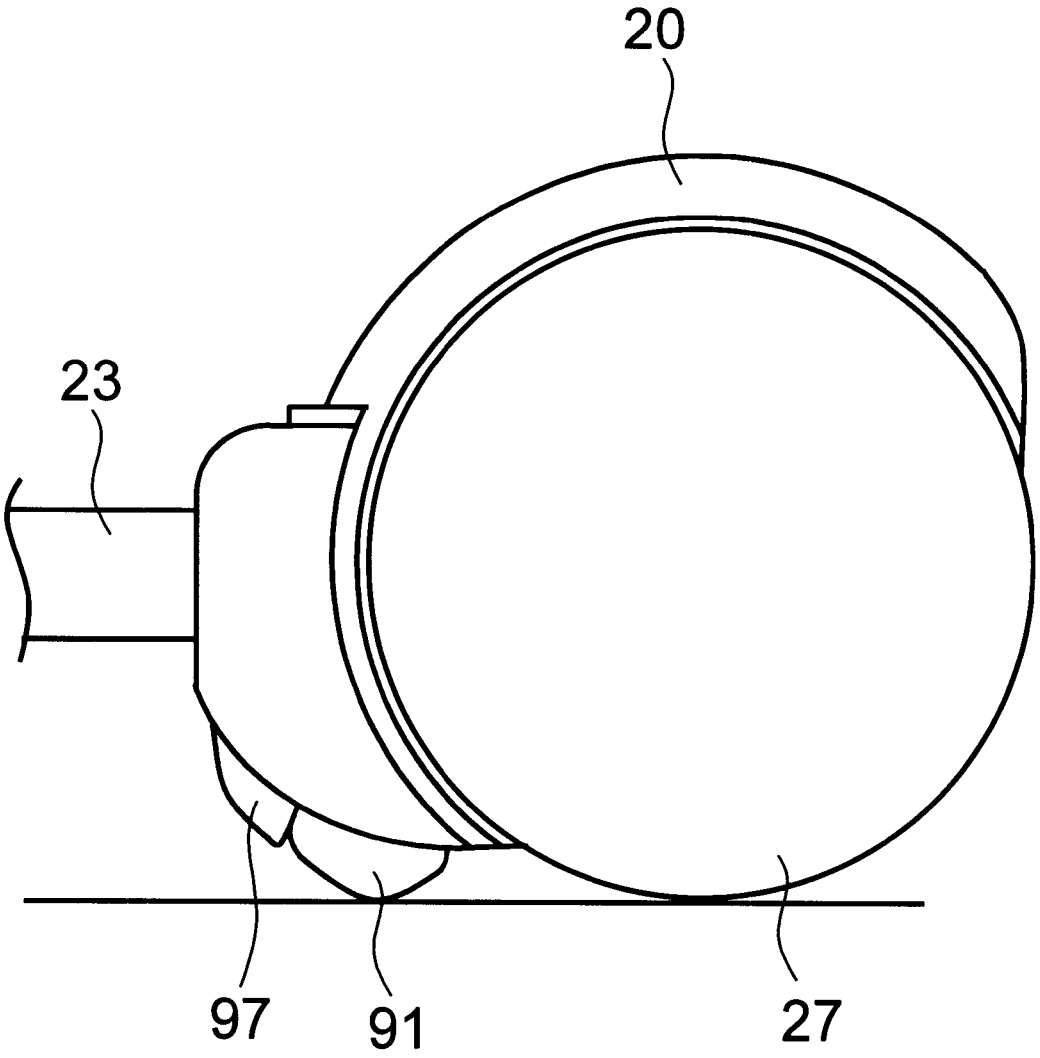
FIG. 30 is a side view of an electric cleaner of an eleventh exemplary embodiment of the present invention.
Figure 31:
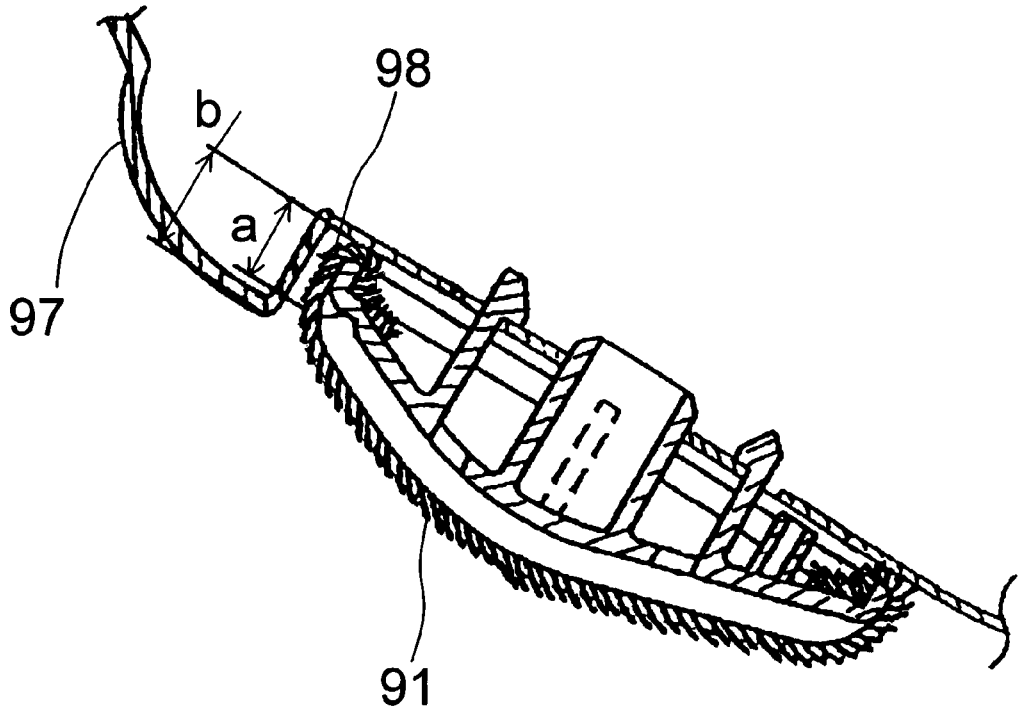
FIG. 31 is a longitudinal sectional view of a portion of a main body of the same cleaner.
Figure 32:
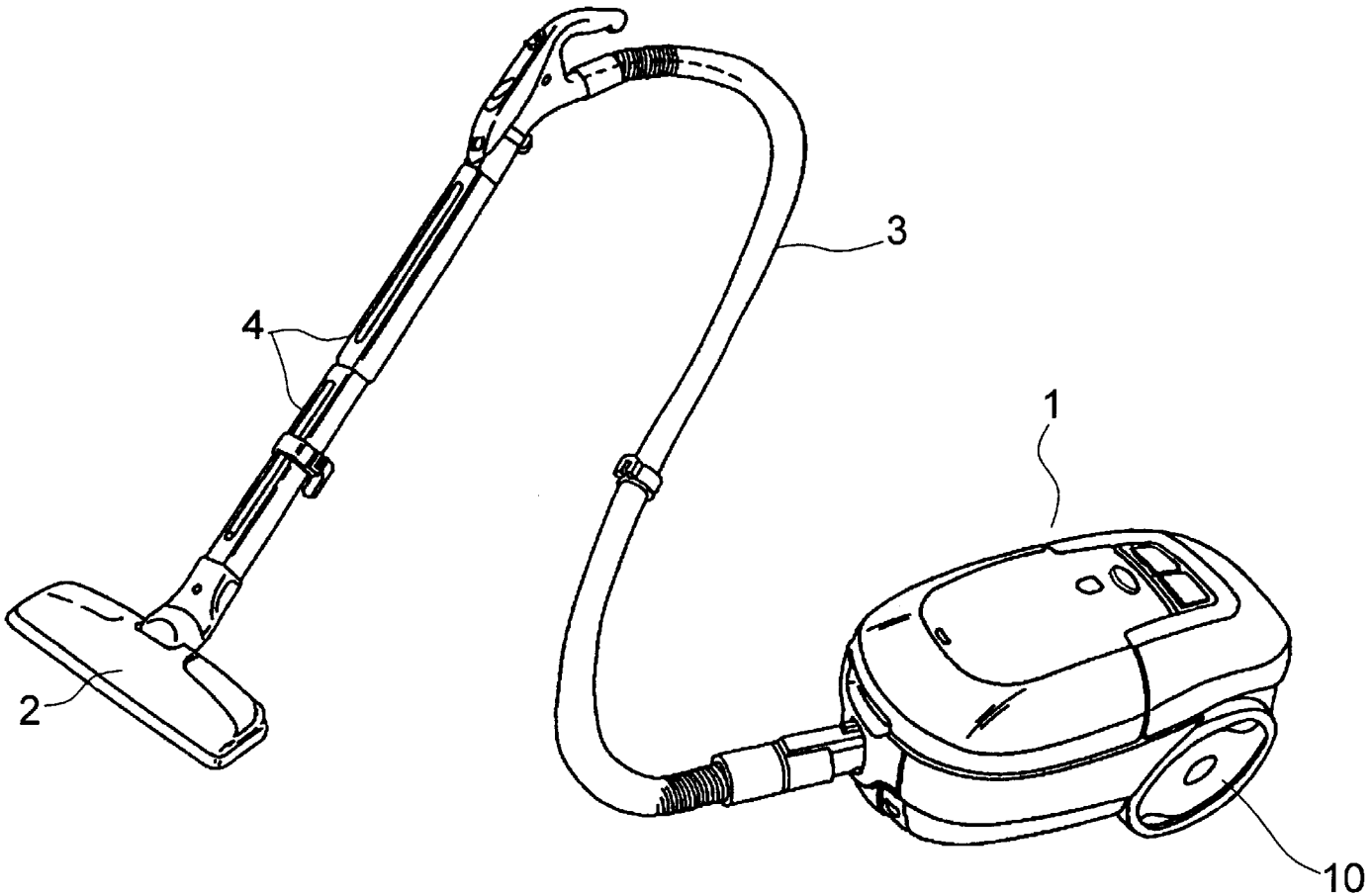
FIG. 32 PRIOR ART
FIG. 32 is a perspective view of an electric cleaner of a first example of the prior art.
Figure 33:
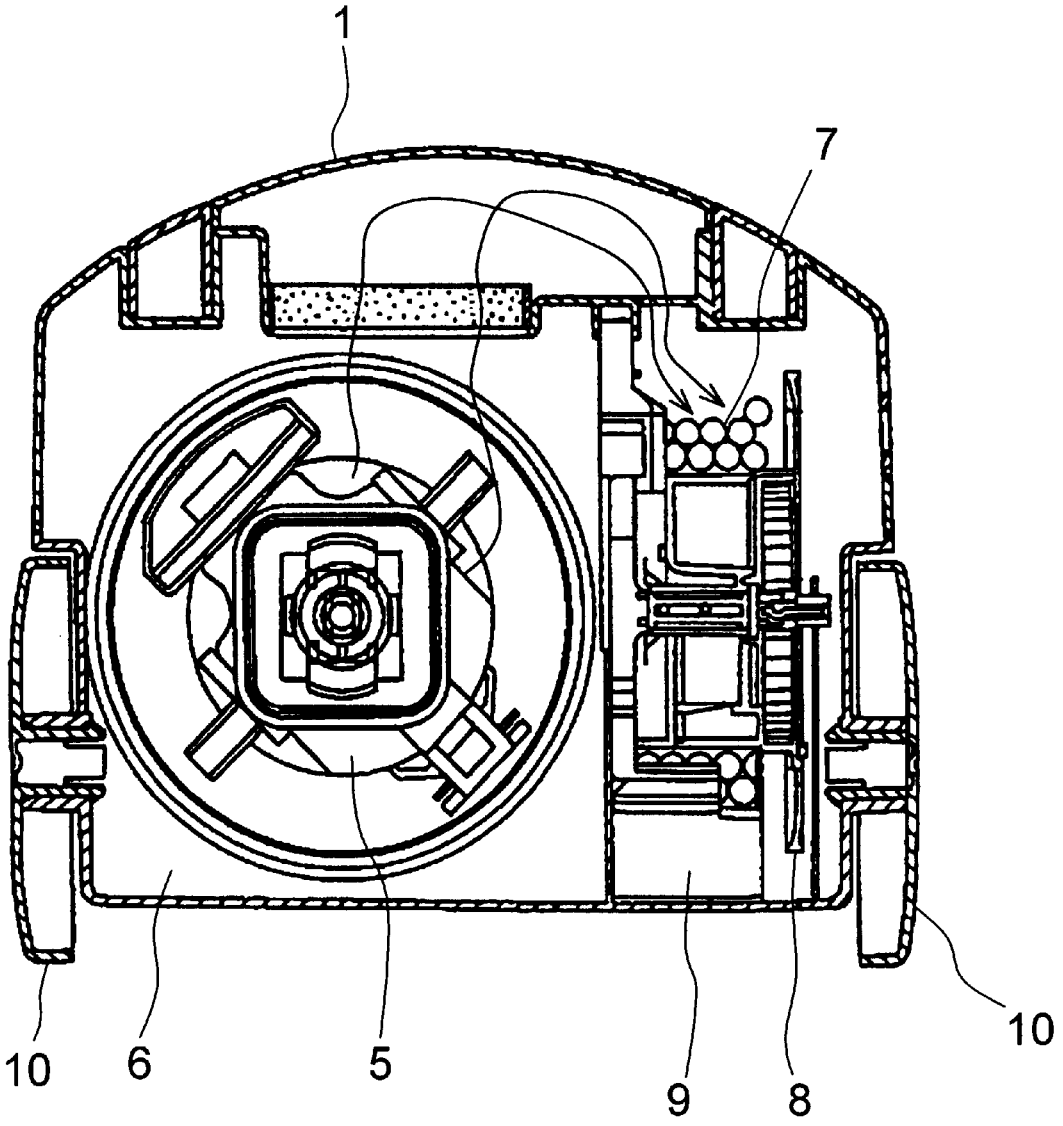
FIG. 33 PRIOR ART
FIG. 33 is a cross sectional view of a main body of the same electric cleaner.
Figure 34:
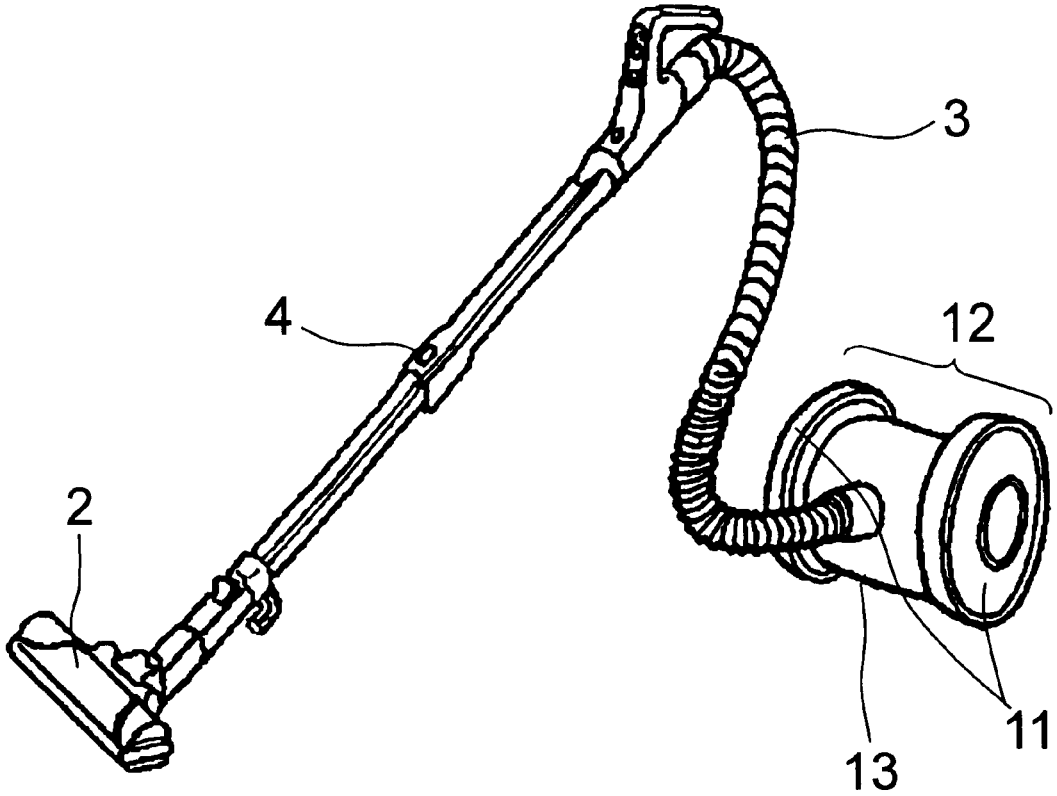
FIG. 34 PRIOR ART
FIG. 34 is a perspective view of an electric cleaner of a second example of the prior art.

A main body is provided with a protuberance 91 constructed of a soft material on its bottom surface where it comes in contact with the floor surface being cleaned, and a protrusion 97 in front of the protuberance 91. The protrusion 97 has a sloped side which rises close to the floor surface to be cleaned as it extends from the front bottom surface to rear of the main body, as shown in FIG. 30. This protrusion 97 is so formed that a rear end with a height (b) comes closer to the floor surface to be cleaned than a vertical wall 98 having a height (a) at a front side of the protuberance 91, as shown in FIG. 31. This prevents the vertical wall 98 of the protuberance 91 from striking directly against an unlevel surface, such as a threshold or the like (not show in the figures), and receiving a stress, when the main body rides over the threshold. Furthermore, the main body rides over a threshold when it is pulled over the threshold, since the protrusion 97 has the sloped side.

What is claimed is:

1. An electric vacuum cleaner comprising:

a main body provided with a cleaner housing containing therein an electric blower for generating suction force and a pair of wheels;

a suction nozzle connected to said main body through an extension pipe and a hose, said suction nozzle suctioning on a floor surface being cleaned during operation of said electric blower; and a dust chamber for collecting dust, said chamber being located between said suction nozzle and said electric blower, wherein said main body has two side surfaces, both of which extend outwardly toward and beyond rim portions of said respective wheels, and the center of gravity of said main body is positioned so that said main body is urged to return itself to an original posture when one of said two side surfaces contacts the floor surface.

2. The electric vacuum cleaner as set forth in claim 1 wherein said wheels project toward the floor surface beyond a bottom surface of said cleaner housing.

3. The electric vacuum cleaner as set forth in claim 1 wherein a cross sectional shape of said main body is generally circular or generally oval shaped.

4. The electric vacuum cleaner as set forth in claim 1 wherein said main body is generally spherical or generally spherically polyhedral in shape.

5. The electric vacuum cleaner as set forth in claim 4 wherein said wheels are provided on both side surfaces of said cleaner housing.

6. The electric vacuum cleaner as set forth in claim 5 wherein said wheels are constructed so that a distance between bearings of said wheel is longer than a distance between rim portions of said wheels.

7. The electric vacuum cleaner as set forth in claim 5 comprising a supporting slide member disposed between said wheels and said cleaner housing, said supporting slide member being capable of supporting the weight of said main body.

8. The electric vacuum cleaner as set forth in claim 7 wherein said supporting slide member is formed of a material having a frictional resistance lower than a material composing said wheels and said cleaner housing.

9. The electric vacuum cleaner as set forth in claim 5, wherein an outer surface of said cleaner housing is projected into an interior side space of each of said wheels, and a space behind said cleaner housing contains at least any of said electric blower, at least one battery, and a passage formed therein for exhaust air delivered from said electric blower.

10. The electric vacuum cleaner as set forth in claim 4 comprising a protrusion serving as a carrying handle formed on at least an upper part of said cleaner housing, whereby said main body including said protrusion forms an exterior shape of generally spherical or generally spherically polyhedral.

11. The electric vacuum cleaner as set forth in claim 4 wherein rotational axes of said wheels are canted upwardly with respect to the floor surface.

12. The electric vacuum cleaner as set forth in claim 4, wherein the center of gravity of said main body, rotatable about an axis of said wheels, is placed in a position rearward of and below said axis of said wheels so that a connecting port of said main body for connection of said hose to said main body tilts upwardly, when said hose is connected to said main body and said hose is disconnected from said main body.

13. The electric vacuum cleaner as set forth in claim 4, wherein:

said cleaner housing contains a battery and a charge terminal, said charge terminal providing a charge to said battery; and said electric vacuum cleaner further comprises a charge stand for receiving said main body, said charge stand being provided with a charge terminal connector for charging said battery, and a guide alley on at least one end thereof for guiding the wheels of said electric vacuum cleaner onto said charge stand, thereby said charge terminal comes into connection with said charge terminal connector when said main body is moved into a position on said charge stand.

14. The electric vacuum cleaner as set forth in claim 18, wherein said charge stand includes a receiving apparatus for receiving and stabilizing any of said suction nozzle and said extension pipe.

15. The electric vacuum cleaner as set forth in claim 4, further comprising a battery housed in said main body.

16. The electric vacuum cleaner as set forth in claim 4, further comprising a power supply cord, said cleaner housing contains therein said electric blower and a cord-reel chamber for storing said power supply cord.

17. The electric vacuum cleaner as set forth in claim 4, further comprising a cord-reel stand for receiving a cord, a first end of said cord being connected to said main body.

18. The electric vacuum cleaner as set forth in claim 1, wherein said hose is provided with a connector pipe at one end for connection to said cleaner housing and an end pipe at another end for connection with said extension pipe, and at least one of said connector pipe and said end pipe is freely rotatable about a longitudinal axis thereof.

19. The electric vacuum cleaner as set forth in claim 1, further comprising a one or a plurality of batteries housed in said main body.

20. The electric vacuum cleaner as set forth in claim 19, wherein said electric blower and said battery are disposed respectively in an upper space and a lower space within said cleaner housing, and said battery is heavier than said electric blower.

21. The electric vacuum cleaner as set forth in claim 20, wherein the center of gravity of said main body is located towards either side with respect to a lateral center of said main body.

22. The electric vacuum cleaner as set forth in claim 21, wherein the center of gravity of said one or a plurality of batteries housed within said cleaner housing is located away from the lateral center of said main body, thereby the center of gravity of said main body is located towards either side with respect to said lateral center.

23. The electric vacuum cleaner as set forth in claim 1, further comprising a power supply cord, said cleaner housing contains therein said electric blower and a cord-reel chamber for storing said power supply cord.

24. The electric vacuum cleaner as set forth in claim 23 wherein said cord-reel chamber for storing said power supply cord is disposed above said electric blower, and said electric blower is heavier than said cord-reel chamber for storing said power supply cord.

25. The electric vacuum cleaner as set forth in claim 23, wherein:

said cord-reel chamber for storing said power supply cord and said electric blower are disposed in juxtaposition at each side within said main body in a generally parallel plane to the floor surface.

26. The electric vacuum cleaner as set forth in claim 25, wherein the center of gravity of said electric blower is located towards either side below a general center of said main body, thereby the center of gravity of said main body is shifted to either side with respect to, and below said general center.

27. The electric vacuum cleaner as set forth in claim 23 wherein an opening for drawing out said power supply cord is located in a general center of a rear side of said main body.

28. The electric vacuum cleaner as set forth in claim 23 wherein an opening for drawing out said power supply cord from said main body is located in a general center of one of said wheels.

29. The electric vacuum cleaner as set forth in claim 1, further comprising a cord-reel stand for receiving a cord, a first end of said cord being connected to said main body.

30. The electric vacuum cleaner as set forth in claim 1, wherein said cleaner housing is provided with a protuberance composed of a support frame having a cushioning material including any of fabric, unwoven cloth, and foam material attached thereto, and said protuberance is mounted on said cleaner housing.

31. The electric vacuum cleaner as set forth in claim 30, wherein foam is disposed between said cushioning material and said support frame.

32. The electric vacuum cleaner as set forth in claim 1 wherein said cleaner housing is provided with a protuberance composed of a cushioning material on a bottom surface of said cleaner housing where said cleaner housing comes in contact with the floor surface being cleaned.

33. The electric vacuum cleaner as set forth in claim 32 wherein only said wheels of said main body contact the floor surface when the electric vacuum cleaner is moved across the floor surface.

34. The electric vacuum cleaner as set forth in claim 32 wherein said cushioning material is comprised of any of fabric, unwoven cloth, and foam material.

35. The electric vacuum cleaner as set forth in claim 34, wherein fabric serving as said cushioning material is disposed so that a leaning direction of nap of said fabric is oriented toward a rear end of said cleaner housing.

36. The electric vacuum cleaner as set forth in claim 32, wherein said cleaner housing additionally comprises a protrusion adjacent said protuberance, said protrusion having a sloped side extending near the floor surface to be cleaned, said sloped side extends from the front of said bottom surface towards the rear of said main body.

37. The electric vacuum cleaner as set forth in claim 32, wherein any of said protuberance and said cushioning material is oriented to contact the floor surface upon said hose being connected to said cleaner housing.

* * * * *

UNITED STATES PATENT AND TRADEMARK OFFICE

CERTIFICATE OF CORRECTION

PATENT NO. : 6,536,073 B2
DATED : March 25, 2003
INVENTOR(S) : Uratani et al.

It is certified that error appears in the above-identified patent and that said Letters Patent is hereby corrected as shown below:

Title page,
Item [57], ABSTRACT, replace the ABSTRACT with the following,
-- An electric cleaner is provided with a main body including a cleaner housing equipped with wheels for mobility on a floor surface. Both side surfaces of the main body extend outwardly beyond rim portions of the respective wheels that stay in contact with the floor surface, and a center of gravity G of the main body is placed in such a position that the main body rolls toward a direction where the wheels stand on the floor surface so as to return itself into a original posture when the main body tilts in a way that one of the side surfaces lies in contact to the floor. --

Column 12,
Line 20, "wherein foam" should read -- wherein a foam --.

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,536,073 B2
DATED : March 25, 2003
INVENTOR(S) : Uratani et al.

It is certified that error appears in the above-identified patent and that said Letters Patent is hereby corrected as shown below:

Column 10,
Line 62, “18” should read -- 13 --.

Signed and Sealed this

Twenty-seventh Day of September, 2005

JON W. DUDAS
*Director of the United States Patent and Trademark Office*